US006535170B2

(12) United States Patent
Sawamura et al.

(10) Patent No.: US 6,535,170 B2
(45) Date of Patent: Mar. 18, 2003

(54) DUAL BAND BUILT-IN ANTENNA DEVICE AND MOBILE WIRELESS TERMINAL EQUIPPED THEREWITH

(75) Inventors: Masatoshi Sawamura, Saitama (JP); Yoshiki Kanayama, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/013,781

(22) Filed: Dec. 10, 2001

(65) Prior Publication Data

US 2002/0093456 A1 Jul. 18, 2002

(30) Foreign Application Priority Data

Dec. 11, 2000 (JP) ..... 2000-376008

(51) Int. Cl.[7] ..... H01Q 1/24

(52) U.S. Cl. ..... 343/702; 343/700 MS

(58) Field of Search ..... 343/700 MS, 702, 343/795, 829, 846, 848; H01Q 1/24, 1/38

(56) References Cited

U.S. PATENT DOCUMENTS

| | | | | |
|---|---|---|---|---|
| 3,622,890 A | * | 11/1971 | Kyohei | 325/375 |
| 6,025,805 A | * | 2/2000 | Smith et al. | 343/702 |
| 6,130,650 A | * | 10/2000 | Curtis et al. | 343/846 |
| 6,323,821 B1 | * | 11/2001 | McLean | 343/795 |
| 6,344,823 B1 | * | 2/2002 | Deng | 343/700 MS |

* cited by examiner

*Primary Examiner*—Tho Phan
(74) *Attorney, Agent, or Firm*—Frommer Lawrence & Haug LLP; William S. Frommer

(57) ABSTRACT

A dual band built-in antenna device operable in a first frequency band and a second frequency band is provided. The antenna device comprises a ground plane comprising a ground member, a first inverted-L line antenna element for the first frequency band, and a second inverted-L line antenna element for the second frequency band. The first and second inverted-L line antenna elements are so constructed that the elements are extended to respective directions that are further separated from each other as the antenna elements extend further from a starting position set in proximity to a power feed point within a plane parallel to the ground plane.

20 Claims, 22 Drawing Sheets

: RADIATION CONDUCTOR PART f1 : LOW FREQUENCY BAND f2 : HIGH FREQUENCY BAND

DUAL BAND BUILT-IN ANTENNA DEVICE AND MOBILE WIRELESS TERMINAL EQUIPPED THEREWITH

RELATED APPLICATION DATA

This application claims priority to Japanese Patent Application JP 2000-376008, and the disclosure of that application is incorporated herein by reference to the extent permitted by law.

BACKGROUND OF THE INVENTION

1. Field of the Invention

The present invention relates to a mobile wireless terminal used for mobile communications such as a mobile telephone. Particularly, the present invention relates to a built-in antenna device disposed inside a terminal of so-called a dual band terminal which is operable at two different frequency bands.

2. Description of the Related Art

As the use of mobile telephones has spread rapidly in recent years, it has produced a tendency that a wireless communications system having single telephone circuit suffers a shortage of circuits, so that various devices and systems have been proposed to provide the necessary number of circuits by jointly using two kinds of wireless communications systems based on different frequency bands. In known such arrangements, the dual band mobile telephone terminal capable of operating in two kinds of wireless communications systems with single mobile wireless apparatus has been developed and made commercially available.

A multiplex terminal which can jointly use PDC (Personal Digital Cellular) operation on 800 MHz band and PHS (Personal Handyphone System) operation on 1.9 GHz band has been made commercially available in Japan. Another multiplex terminal capable of jointly using GSM (Global System for Mobile Communication) operation on 900 MHz band and DCS (Digital Communication System) operation on 1.8 GHz band has also been on the market in Europe and Asian countries. Moreover, another multiplex terminal which can operate on both AMPS (Advanced Mobile telephone Service) using 800 MHz band and PCS (Personal Communication Service) using 1.9 GHz band has been on sale in the United States.

As a recent trend of mobile wireless terminals for mobile communications, there are put on sale a number of terminals containing so-called built-in antenna disposed inside the terminal body. As compared with the related art antenna attached to outside a mobile wireless terminal body (so-called whip antenna), the built-in antenna has the advantage of that it is less likely to be damaged due to a fall or the like as well as additional benefits such as ease of designing.

FIG. 18 shows an example of a construction of a plate-type (micro-strip) inverted F antenna that is used as a built-in antenna for a mobile wireless terminal of the related art, consisting essentially of a micro-strip radiation conductor 171, a ground 172 facing thereto, a short-circuit part (short-circuit conductor) which short-circuits the radiation conductor 171 to the ground 172, and a power feed pin (feed conductor) 173 which feeds power to the radiation conductor 171. Drawings in the present specification schematically show a power feed part with an AC mark.

Since a resonance frequency of such an antenna is typically determined by a size of the radiation conductor 171, there is employed a related art method, as shown in FIG. 19, for making it dual band function possible by means of forming a slit 177 (cut-out portion) in the micro-strip radiation conductor part 171 to provide for two different resonance lengths of a lower frequency band f1 and a higher frequency band f2, whereby two resonance characteristics are produced.

A distance (spacing) between the radiation conductor 171 and the ground 172 affects the bandwidth of an antenna. Specifically, enlargement of a cubic volume sandwiched by the radiation conductor 171 and the ground 172 tends to increase the bandwidth. It should be pointed out, however, that much as an antenna can be made smaller by filling the space between the radiation conductor 171 and the ground 172 with a dielectric. The antenna made smaller in this fashion tends to result in decreasing the bandwidth.

The short-circuit part 175 is one of key features of the micro-strip inverted F antenna, and capable of reducing the radiation conductor area to about a quarter in size as compared with a micro-strip antenna devoid of the short-circuit conductor with a square shaped radiation conductor. The micro-strip antenna without the short-circuit conductor is one of the most typical type of a plane antenna.

When the power feed pin 173 is attached to a position, at which matching of an input impedance on the radiation conductor 171 to an impedance of a feed circuit (not shown) which is formed on the circuit substrate can be achieved, feeding the antenna is rendered possible.

FIG. 20 is a diagram showing an example of a micro-strip inverted F antenna disposed in a mobile wireless terminal. This is a schematic representation of parts associated with the antenna thereof, parts not associated with the configuration of the antenna being omitted.

The mobile wireless terminal is typically composed of a circuit substrate which comprises circuits required for operating of a mobile wireless terminal, a shield case for shielding the circuit substrate (not shown in the figure), and an outer frame (not shown in the figure) for protecting these parts. Installation of a built-in antenna therein may be done in several ways. In one case, a ground of the circuit substrate is used as a ground of the antenna. In another case, the shield case is used as a ground. In still another case, that is an intermediate case of these two preceding cases, the shield case makes up part of the internal portion of the antenna. In another aspect of the related art mobile wireless terminal installed with the built-in antenna, it is typical to use non-conductive material such as resin, at least, as the material of the outer frame in proximity to the antenna.

The radiation conductor 171 is made up of a sheet metal to be attached to inside of the non-conductive outer frame or mounted on a spacer disposed between a radiation conductor made of a non-ferrous metal such as a resin and a ground, whereas the short-circuit conductor and the power feed conductor are composed of a spring connector (power feed spring) of an expanding and contracting structure. The spring connector is connected mechanically and electrically to the circuit substrate by using a method such as soldering. It should be noted that the spring connector operating as the short-circuit conductor is connected to the ground of the circuit substrate, while the spring connector operating as the power feed conductor is connected to a conductor pattern formed on the circuit substrate and connected to the power feed circuit.

Furthermore, just in the possible case of a mobile wireless terminal being dropped and causing damage to its circuit substrate on strong impact, it is general practice to fix the circuit substrate with the outer frame with some degree of freedom of movement for purposes of alleviating any possible damage thereto.

With regards to the above-mentioned dual band microstrip inverted F antenna with a slit, formation of the slit makes it substantially equivalent to the case of having two antenna elements with resonance lengths for respective frequency bands.

SUMMARY OF THE INVENTION

Nevertheless, inasmuch as these two antenna elements are in proximity to each other, the effect on mutual frequency bands, i.e., the so-called effect of mutual coupling, becomes unavoidably substantial. Namely, it is difficult for any one of the frequency bands alone to be subjected to an independent impedance adjustment.

Although the impedance adjustment can be carried out in terms of a distance adjustment between the short-circuit part 175 and the power feed pin 173, in many instances, the distance between these two parts reaching the optimum for one frequency band is different from the optimum for the other frequency. Accordingly, carrying out of independent impedance adjustment for only one of the frequency bands is not easy whatsoever. Further, the antenna occupying volume is determined by a spacing distance between the radiation conductor 171 and the ground 172 facing thereto. In the standpoint of securing antenna characteristics, it is difficult to dispose any parts necessary for a mobile wireless terminal other than an antenna in the region between the radiation conductor 171 and the ground 172.

The present invention is directed to alleviate or solve these problems. It is desired to provide a dual band built-in antenna device with antenna elements capable of conducting independent impedance adjustments for the first and second antenna elements with comparative ease, and a mobile wireless apparatus equipped therewith.

It is also desired to provide a dual band built-in antenna device with antenna elements capable of conducting adjustments regarding SAR (to be explained later) and adjustments regarding the restraint of the degradation of antenna characteristics with comparative ease, and a mobile wireless apparatus equipped therewith.

According to one embodiment of the present invention, there is provided a dual band built-in antenna device, that can be operated in a first frequency band and a second frequency band, including a ground member constituting a ground plane, a first and second inverted-L line antenna elements corresponding respectively with a first frequency band and a second frequency band. The first and second inverted-L line antenna elements are formed in a strip-line shape and configured that the two antenna elements are extended, at least initially, to different directions (directions separating from each other) from a starting position disposed in proximity to a power feed point. A separation between these two elements increases as the antenna elements extend further from the starting position. The starting point is disposed within a plane facing to the ground plane. Alternatively, the starting positions and the power feed points for the two antenna elements may be provided, respectively.

The present embodiment makes it possible to reduce the area of a radiation conductor part in each of the first and second inverted-L line antenna elements. According to the present embodiment, a smaller inverted L-shaped antenna is realized by folding a monopole antenna midway. To provide dual band compatibility (dual resonance), the possible mutual coupling effect is decreased or eliminated by constructing both antenna elements so that these elements are extended to the directions separating from each other from the starting position disposed in proximity to the power feed point that is disposed in the plane facing to the ground plane. Accordingly, each of resonance lengths of the first and the second inverted-L line antenna elements may be adjusted independently.

Formation of the line-type antenna elements contributes to increasing of the degree of freedom in disposing the first and the second antenna elements and enabling of the elements to be arranged according to a variety of purposes.

Further, in a common matching circuit, impedance matching can be conducted easily for both frequency bands.

Still further, inasmuch as the line-type antenna elements are disposed in such a way that these elements are extended to the directions separating from each other, a comparatively wide area devoid of any radiation conductor is created in the region surrounded by the antenna elements, thereby making it possible to place parts or devices other than the antenna elements thereon.

BRIEF DESCRIPTION OF THE DRAWINGS

The other objects, features and advantages of the present invention will become more apparent from the following description of the presently preferred exemplary embodiments of the invention taken in conjunction with the accompanying drawings, in which.

DESCRIPTION OF THE PREFERRED EMBODIMENTS

Preferred embodiments of the present invention will be described with reference to the accompanied drawings.

Figure 21:
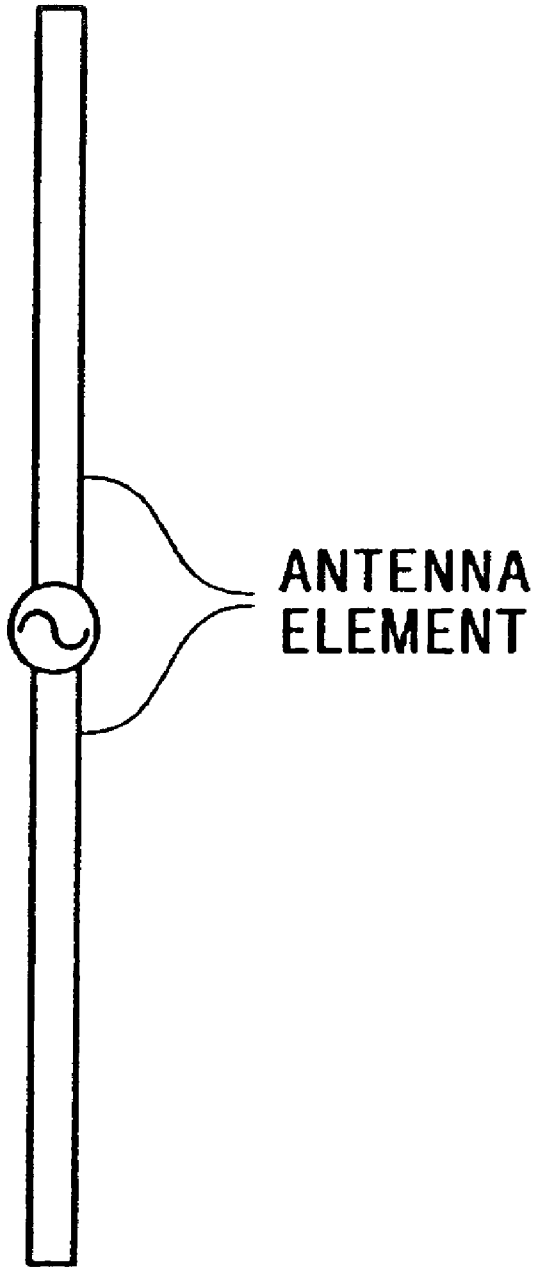
FIG. 21 shows a diagram of a dipole antenna.
Figure 22:
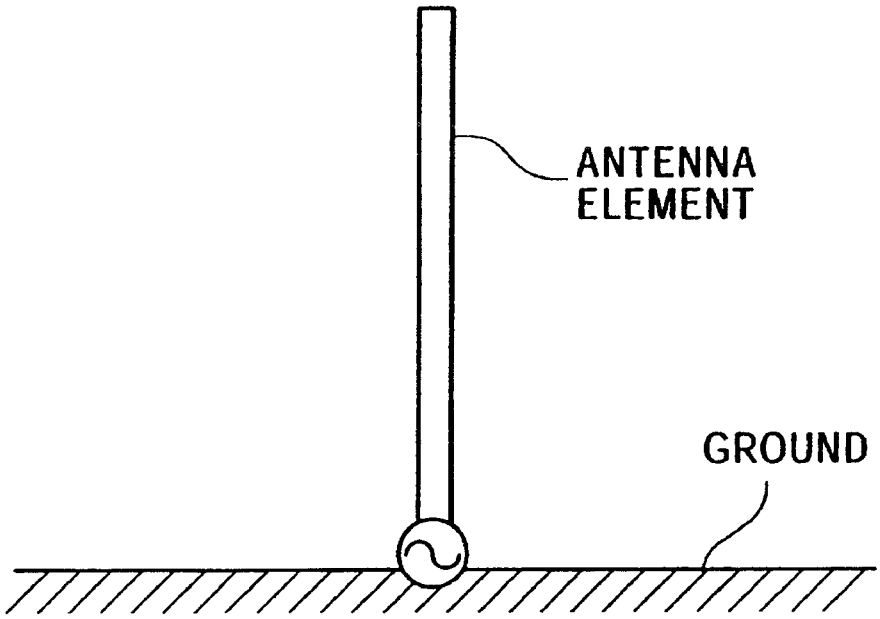
FIG. 22 shows a diagram of a monopole antenna installed on a wide ground of one wavelength or more with respect to a frequency in use.

First, referring to FIGS. 21, 22, and 23, an inverted-L antenna used in the following embodiments of the present invention will now be briefly described. A half-wavelength dipole antenna and a quarter-wavelength monopole antenna are known as a line-type of antenna. As shown in FIG. 22, it is assumed that an imaginary current due to its wide ground is generated when a quarter-wavelength monopole antenna built on a wide ground plane have one wavelength or more in the frequency used. Accordingly, the antenna characteristic is substantially equivalent to the antenna characteristic of a half-wavelength dipole antenna of a symmetrical structure as shown in FIG. 21.

Figure 23:
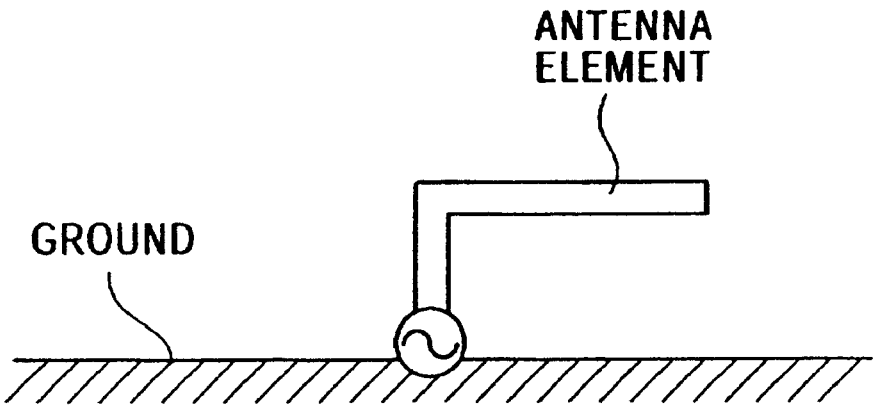
FIG. 23 shows a diagram of an inverted-L antenna installed on a wide ground of one wavelength or more with respect to a frequency in use.

The inverted-L antenna as shown in FIG. 23 is realized by holding a monopole antenna of FIG. 22 at midway to make it smaller in size, thereby enabling a low posture of the antenna. On the other hand, since a current running in the horizontal part of the antenna element of the inverted-L antenna parallel to the ground has an inverted phase with its imaginary current, the horizontal part does not contribute appreciably to radiation. Accordingly, radiation resistance becomes less than the radiation resistance of the quarter-wavelength monopole antenna. The real component of its input impedance, that is determined by the length of the vertical portion of the antenna element, is small. Furthermore, it should be noted that a reactance portion (imaginary component) to be determined by the length of the element's horizontal part may be set at either a high capacitive value or a high inductive value depending on the electrical length of the antenna element. Accordingly, it is difficult to achieve matching at the power feed point by using only a normal 50 Ω feeder, whereas such problem may be solved by inserting a matching circuit as described later.

In embodiments of the present invention, an inverted-L antenna of the above described type is utilized as a built-in antenna for use of a mobile wireless terminal apparatus.

FIG. 1 shows an example of a construction of a dual-band built-in antenna device in a first embodiment in accordance with the present invention. FIGS. 1A–1C show a perspective view, a plan view, and a side view of the first embodiment, respectively. Also, FIGS. 1D–1F show an example of a modification of the first embodiment, presenting its perspective view, plan view, and side view, respectively. It should be noted that these illustrations are schematic representations of parts associated with an antenna of a mobile wireless terminal apparatus, illustrations of parts not associated with the construction of the antenna (circuit component parts of the inside of the terminal apparatus, an outer frame of the terminal apparatus, or the like) being omitted. The same applies to the drawings hereinafter of the same type.

A mobile wireless terminal apparatus using such a built-in antenna device according to the present embodiment comprises a circuit substrate provided with circuits enabling operations of a mobile wireless terminal apparatus (hereinafter simply referred to as the "terminal"), a shield case for shielding the circuit substrate (not shown in the figure), and an outer frame (not shown in the figure) for protecting these parts. For the built-in antenna, an example is shown for a case where the circuit substrate is used as an antenna's ground. The shield case may be used as the ground or there may be employed a construction wherein part of the internal region of the antenna forms the shield case. Further, a nonconductive material such as resin is used as material for part of the outer frame at least in proximity to the antenna.

Figure 1A:
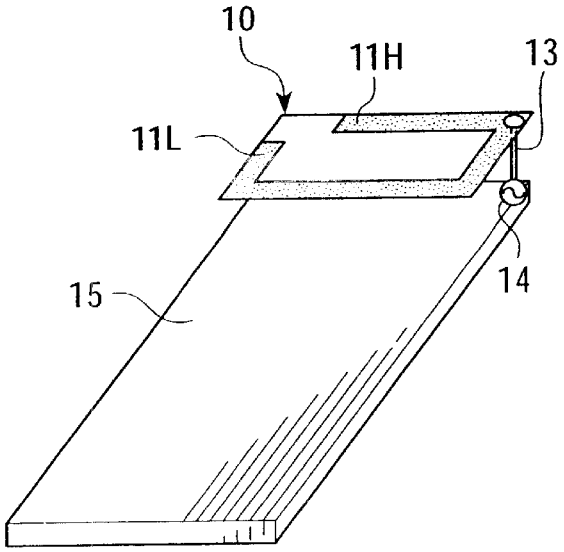
FIGS. 1A–1C show a perspective view, a plan view, a side view of an example of a dual band built-in antenna device of a first preferred embodiment according to the present invention.
Figure 1B:
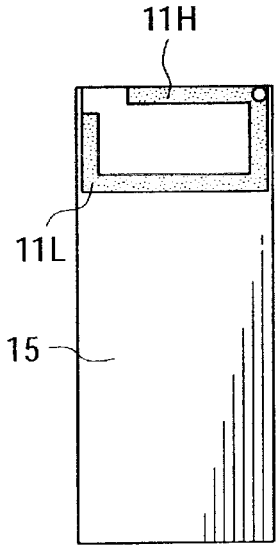
Figure 1C:
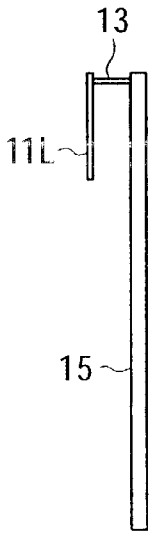

Radiation conductors 11L and 11H in the structure shown in FIG. 1A constitute line-type antenna elements of an inverted L monopole antenna, respectively, together with a power feed pin 13. The radiation conductors 11L and 11H are disposed so as to face a ground (ground member constituting a ground plane) 15. The radiation conductors 11L and 11H may be formed with any conductive member. Methods of supporting the conductors include, for example, bonding to inside of the nonconductive outer frame or disposing the conductors on a spacer (both not shown in the figure) made of nonmetal material such as resin in between the radiation conductors and the ground. The power feed pin 13 may be formed with any conductive member. For example, the pin may comprise a spring connector having an expanding and contracting structure (for example, micro-strip feed spring), the spring connector being mechanically and electrically connected to a power feed point 14 disposed on the circuit substrate by soldering or any other similar method.

The built-in antenna device of the present embodiment is disposed at a position on the top end of the terminal and on the rear side of a speaker (not shown in the figure). The radiation conductors 11L and 11H serving as the inverted-L antenna elements for respective frequency bands of the lower frequency band and the higher frequency band are fed from the power feed point 14 positioned at the top farthest end of the terminal.

In order to avoid or alleviate the mutual coupling effect between these two antenna elements, the following construction is employed. That is, the radiation conductors 11L and 11H, that are two inverted-L antenna elements in the plane parallel to the ground plane, are extended in directions separating from each other (in this case, separating in a "dog legged" manner) starting from a point set at the position of the power feed pin 13, and the power feed pin 13 comprises a feed conductor extending vertically upward from the power feed point 14. To be more specific, the radiation conductors 11L and 11H extend at an angular range of approximately 90 degree to different peripheral sides that cross at one corner of a substantially rectangular region 10 in which these antenna elements are disposed.

The electrical length of the inverted-L antenna element is required to be a length of approximately ⅛ to ⅜ wavelength with respect to the frequency in use. Accordingly, it is necessary to provide a longer setting for the low-band antenna element as compared with the high-band antenna element. That is, the radiation conductor 11L has a longer setting than the radiation conductor 11H. In the present embodiment, there is used a construction wherein the antenna element for the higher band (radiation conductor 11H) is positioned at the top end of the terminal (upper side). The antenna element for the lower band (radiation conductor 11L) extends, at first, to a direction normal to the antenna element for the higher band, i.e. toward the bottom end of the terminal. Then, the antenna element for the lower band extends to the transverse direction of the terminal. If more length is required, the antenna element for the lower band may be folded back up toward the top of the terminal.

Figure 1D:
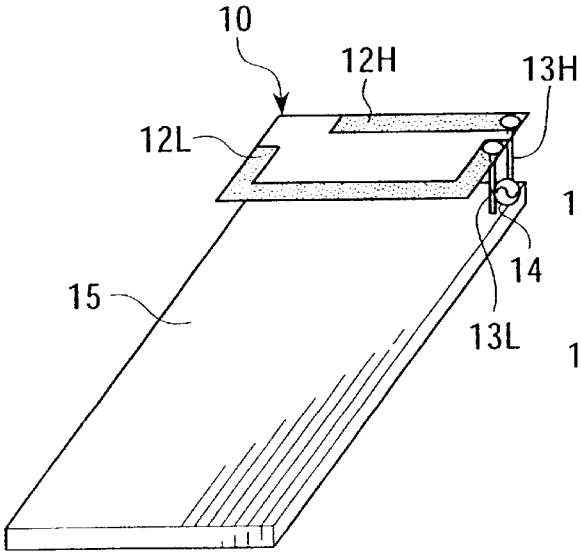
FIGS. 1D–1F show a perspective view, a plan view, and a side view of an example of its modification.
Figure 1E:
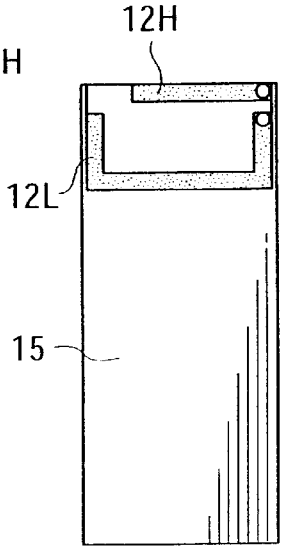
Figure 1F:
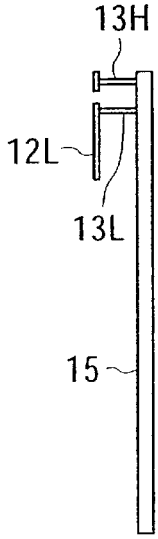

More complete suppression of the mutual coupling effect between these antenna elements may be accomplished by using separate power feed pins for each of these antenna elements. Specifically, as shown in FIG. 1D, a first and second power feed pins 13H and 13L are provided at the feed pattern portion (power feed point 14) on the substrate. This construction ensures separation of the antenna element 12L for the lower band from the antenna element 12H for the higher band even at the power feed pattern portion formed on the substrate. In the following embodiments of the dual band built-in antenna device in accordance with the present invention, implementation of the same means is possible. Both of such means are illustrated in the following figures without any duplicated description.

Figure 2A:
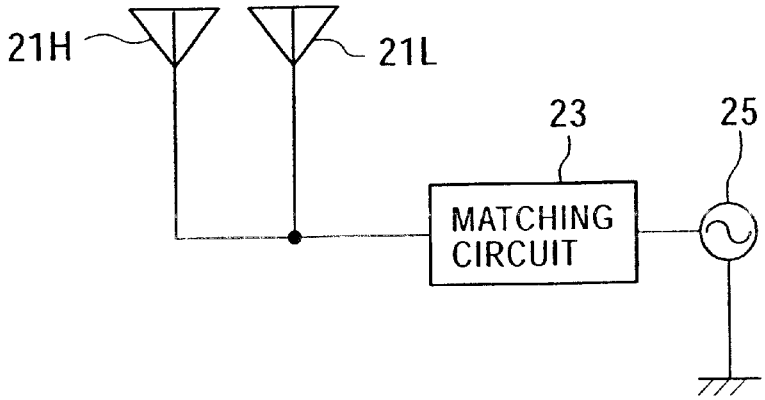
FIGS. 2A–2C show diagrams of a matching circuit for impedance matching in an antenna device according to the present invention.
Figure 2B:
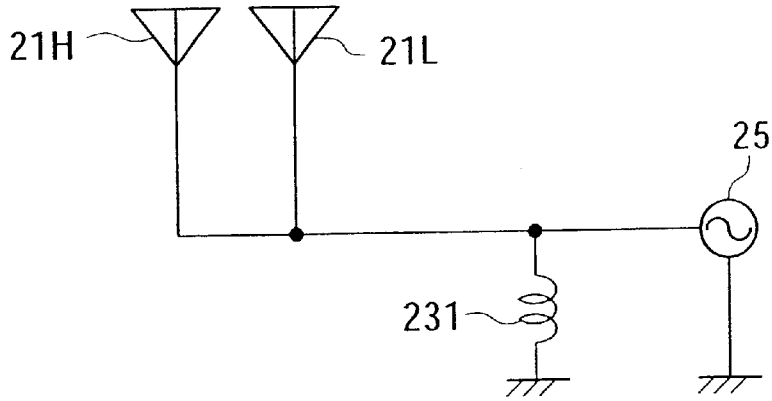
Figure 2C:
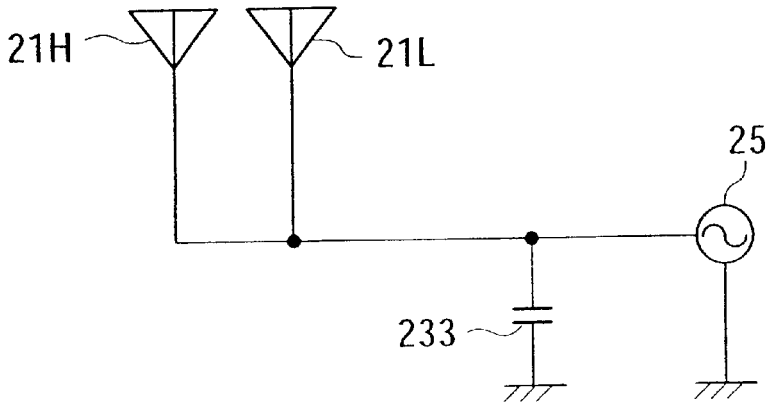
Figure 3A:
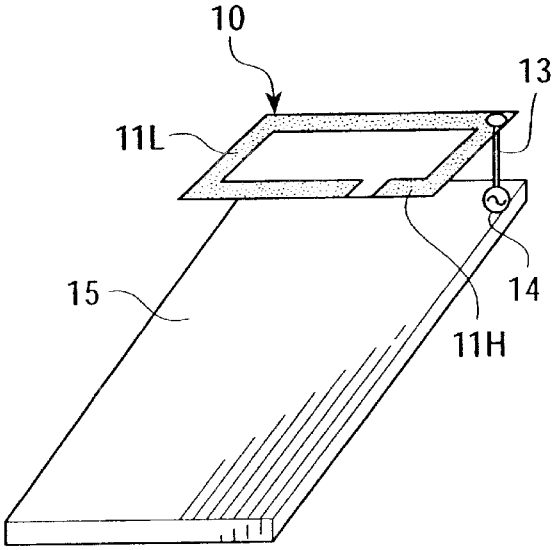
FIGS. 3A–3C show a perspective view, a plan view, a side view of an example of a dual band built-in antenna device of a second preferred embodiment according to the present invention.
Figure 3B:
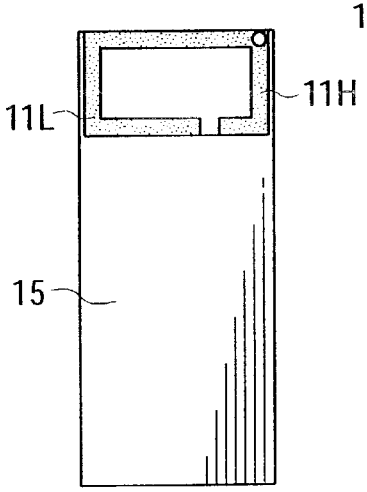
Figure 3C:
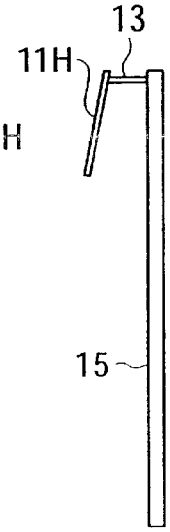
Figure 3D:
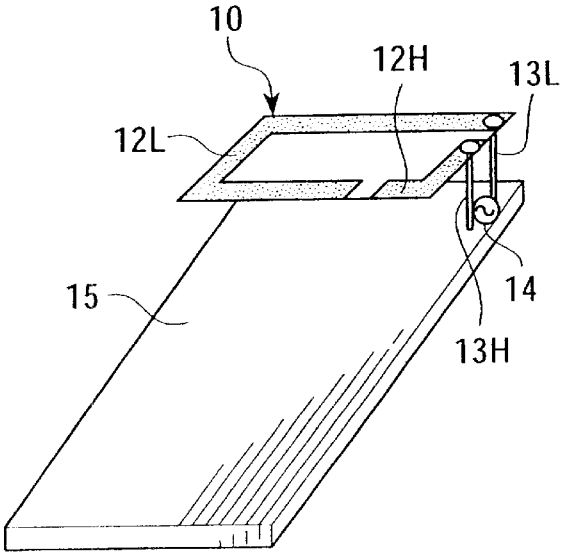
FIGS. 3D–3F show a perspective view, a plan view, and a side view of an example of its modification.
Figure 3E:
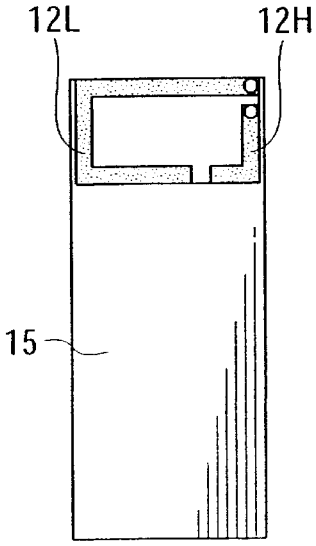
Figure 3F:
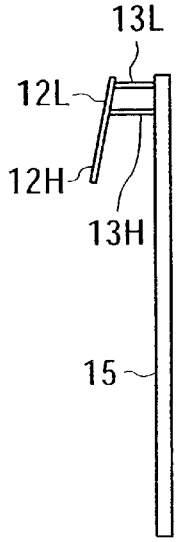
Figure 4A:
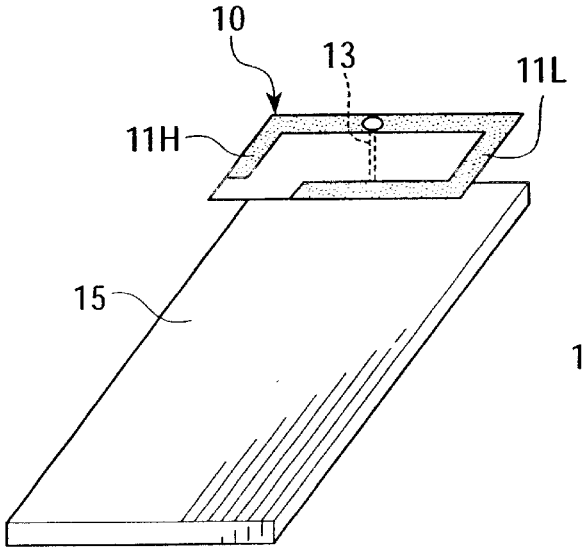
FIGS. 4A–4C show a perspective view, a plan view, a side view of an example of a dual band built-in antenna device of a third preferred embodiment according to the present invention.
Figure 4B:
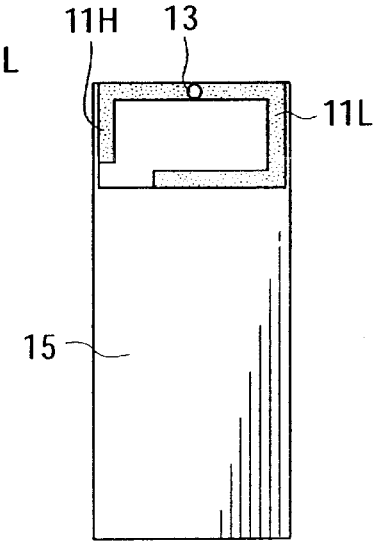
Figure 4C:
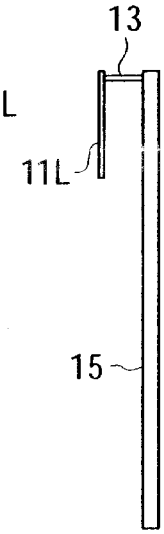
Figure 4D:
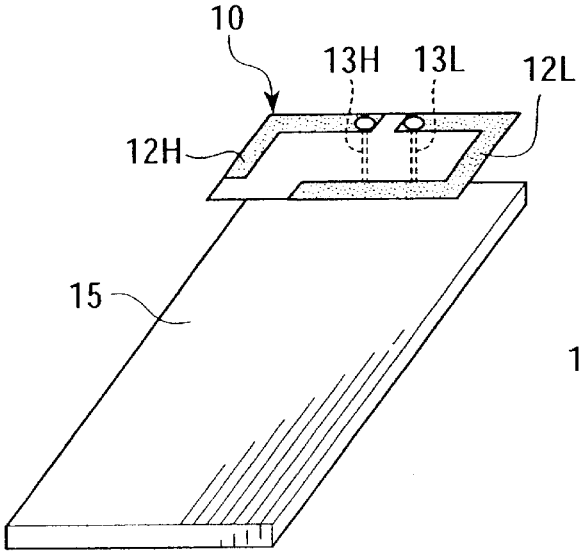
FIGS. 4D–4F show a perspective view, a plan view, and a side view of an example of its modification.
Figure 4E:
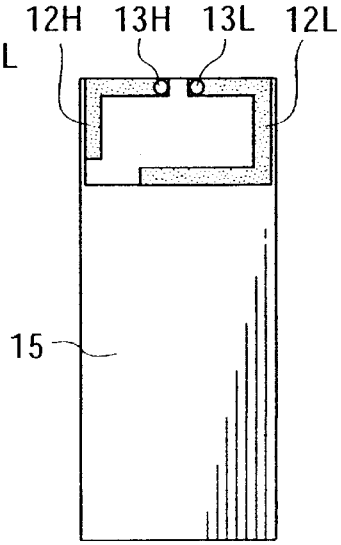
Figure 4F:
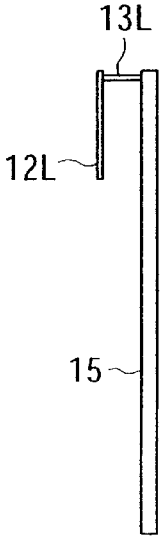

As shown in FIG. 2A, the dual band built-in antenna device of the present embodiment comprises a matching circuit 23 for impedance matching. The matching circuit 23 uses a common circuit for the high band and for the low band. Utilization of such common circuit is made possible by two following reasons. The first reason is that independent adjustments of resonance length and impedance are realized by arranging the two inverted-L antenna elements 21H and 21L for the high band and for the low band in such a way that the mutual coupling effect as mentioned above can be avoided or alleviated. The second reason is that it is comparatively easy to pre-adjust the impedances on the high band side and the low band side so as to reach the same position of the Smith chart as much as possible prior to insertion of the matching circuit 23. Accordingly, the matching can be easily accomplished by inserting an inductive reactance (inductor) element 231 in parallel between the antenna and the ground when the antenna impedance have a large capacitive value, or inserting an capacitive reactance (capacitor) element 231 in parallel therebetween when the antenna impedance have a large inductive value (see FIGS. 2B and 2C). In FIGS. 2A–2C, a reference number 25 stands for a feed signal source.

FIGS. 3A–3F are illustrations showing a second embodiment of a built-in antenna device according to the present invention. This is an example of a construction wherein the external shape of the terminal becomes thicker towards the middle part of the terminal from the top end and the antenna occupying space becomes thicker in like manner. Namely, there is constructed in such a way that an open end portion of the antenna is thicker than the feed portion side so as to increase the bandwidth of the antenna in both the high band and the low band. In this specification, the open end potion of the antenna is part in the other side from the power feed point.

Figure 5A:
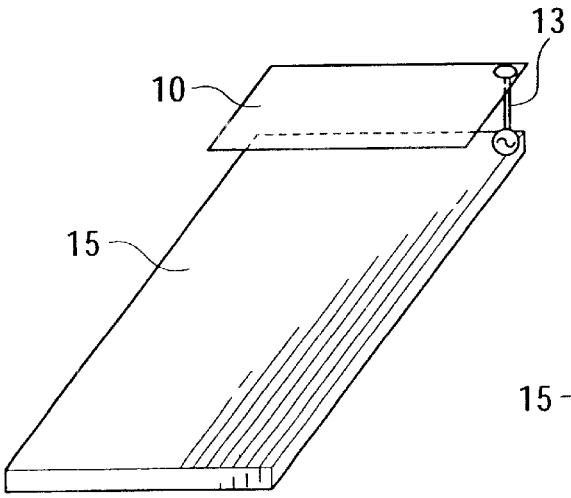
FIGS. 5A–5F show positions of the hot point at the SAR value changing corresponding to the power feed point position to describe a third preferred embodiment of the present invention, respectively through perspective views, plan views, and rear elevations of antenna devices.
Figure 5B:
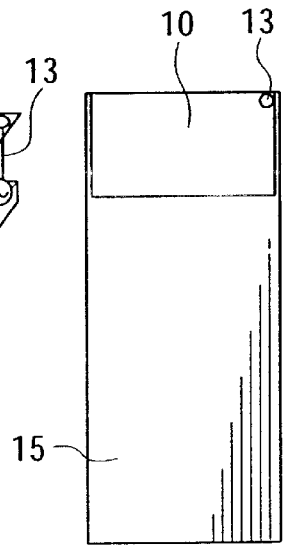
Figure 5C:
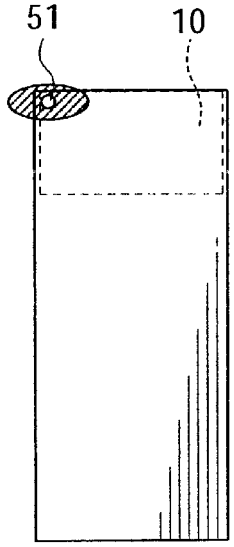
Figure 5D:
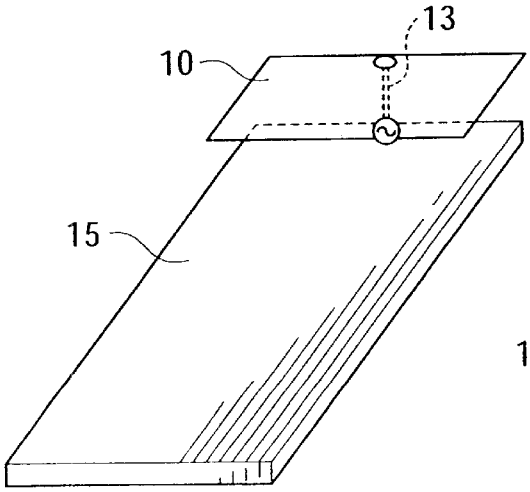
Figure 5E:
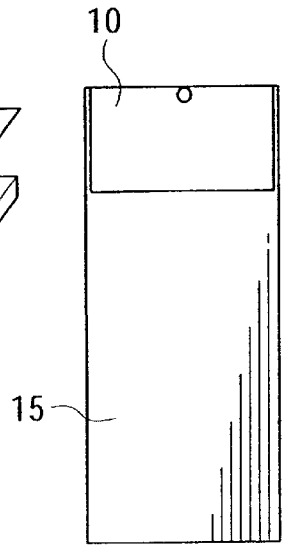
Figure 5F:
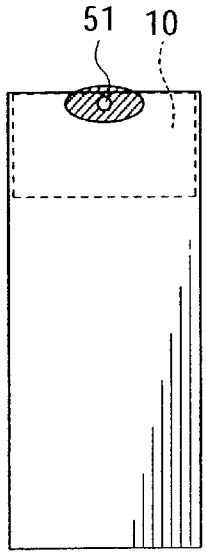

In many cases, a peak position of the SAR distribution of the terminal (or the SAR hot position) appears in proximity to the feed position of the antenna as shown in FIGS. 5A–5F. Here, SAR is Specific Absorption Rate indicating power absorbed by a specific region of the human body per unit time and unit mass. The peak position of the SAR distribution may also depend on the frequency band in use, the ground size of the terminal, and a holding position of the terminal with respect to the human head during the measurement of the SAR. Accordingly, the SAR value of the terminal may varies considerably and also the SAR value of either side sometimes registers higher depending on case of holding the terminal by the right hand (held on the right ear side) or case of holding the terminal by the left hand (held on the left ear side) if the power feed point position of the inverted-L antenna element is disposed at the end (corner) of the terminal in the transverse direction as shown in FIGS. 5A–5C. In order to prevent such undesirable circumstances, the power feed point position of the inverted-L antenna element is positioned in the middle part in the transverse direction of the terminal in the present embodiment. According to such construction of the present embodiment, it makes difficult for a difference in the SAR values to occur when holding the terminal by the right hand and when holding the terminal by the left hand.

FIG. 4. is a schematic external representation of a third embodiment with above-cited consideration. The diagram shows a built-in antenna device when the power feed point position is located in the middle part in the transverse direction of the terminal. In the present embodiment, the same construction is used as the first embodiment shown in FIGS. 1A–1F except for a change in the power feed point position.

Now, referring to FIGS. 6A–6D and FIG. 7, an example of the built-in antenna device according to the present embodiment will be described. Prior to the description, ground dependency characteristics of the antenna for a mobile wireless terminal will be explained.

In a mobile wireless terminal with a ground size smaller than one wavelength of a frequency in use, the ground portion of the terminal substantially operates as an antenna. In other words, the antenna characteristics of the mobile wireless terminal may vary depending on the length (size) of the ground.

Figure 6A:
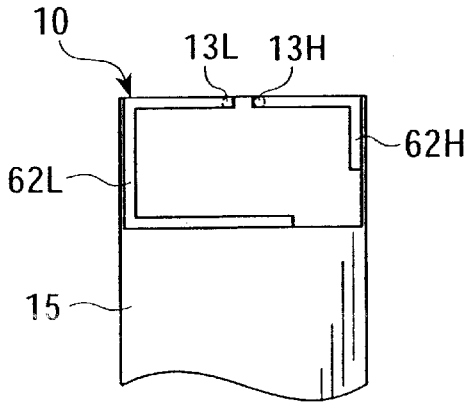
FIGS. 6A–6C show a plan view, a side view, and a plan view to illustrate a structural example of a prototype of an antenna device assuming a dual band terminal apparatus of GSM and DCS.
Figure 6B:
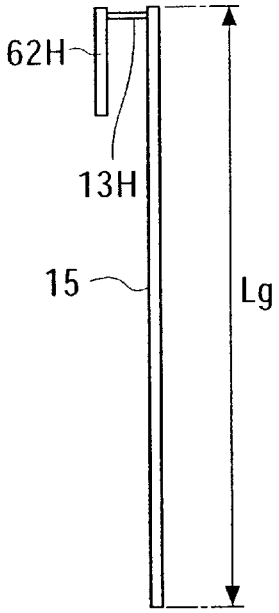
Figure 6C:
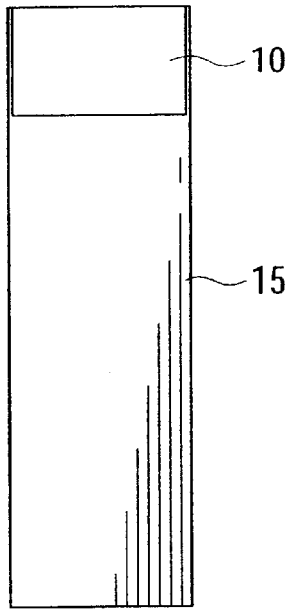
Figure 6D:
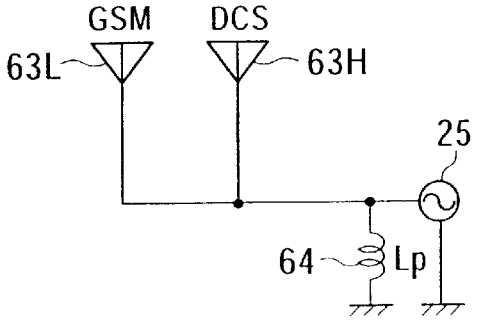
FIG. 6D shows an explanatory diagram of its matching circuit.

FIGS. 6A–6D are a structural example of a dual band terminal that can be operated in the GSM band (880–960 MHz, a required bandwidth of 80 MHz) and the DCS band (1710–1880 MHz, a required bandwidth of 170 MHz). FIG. 6A shows a plan view of an antenna element 11 disposition region 10. FIG. 6B and FIG. 6C respectively show a side view and a plan view of the antenna device. FIG. 6D is a diagram explaining its matching circuit. As shown in FIG. 6A, this antenna device corresponds to the construction of the antenna device shown in FIGS. 4A–4F as mentioned above. The antenna device has a radiation conductor 62L as the antenna element for the GSM band and a radiation conductor 62H as the antenna element for the DCS band, and a matching circuit. The matching circuit comprises an inductance element (Lp) 64 common for both the antenna 63L and the antenna 63H.

Figure 7:
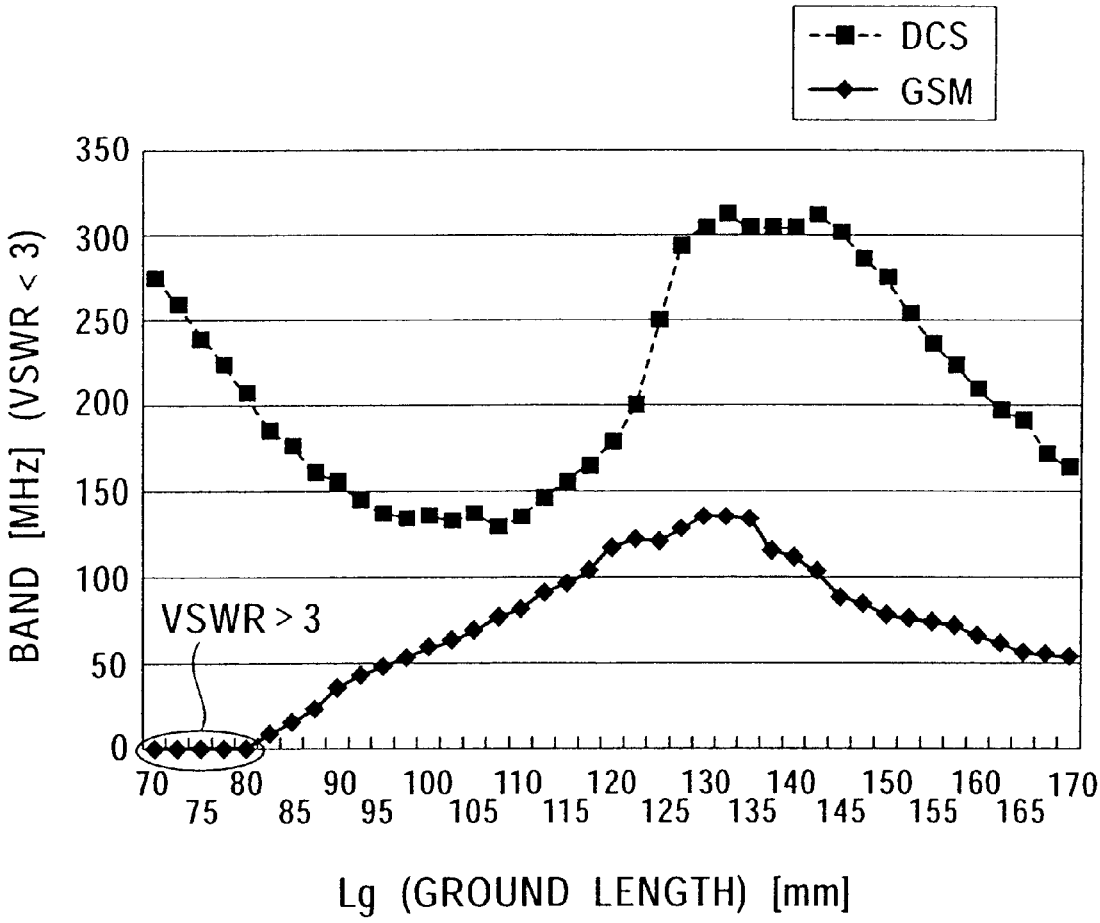
FIG. 7 shows a graph showing an example of the results of measuring changes in the antenna bandwidth with respect to the ground length when the length of the terminal apparatus's ground is changed with respect to an antenna device according to a construction shown in FIG. 6.
Figure 8A:
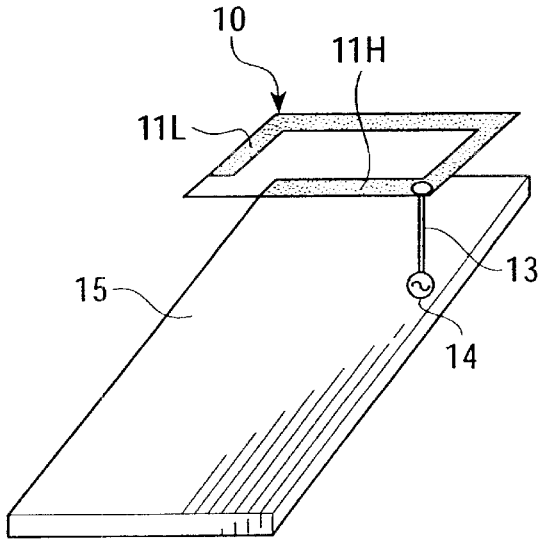
FIGS. 8A–8C show a perspective view, a plan view, a side view of an example of a dual band built-in antenna device of a fourth preferred embodiment according to the present invention.
Figure 8B:
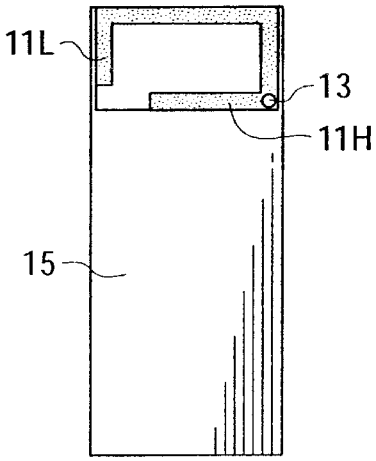
Figure 8C:
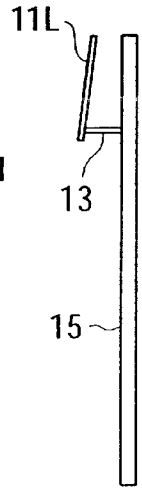
Figure 8D:
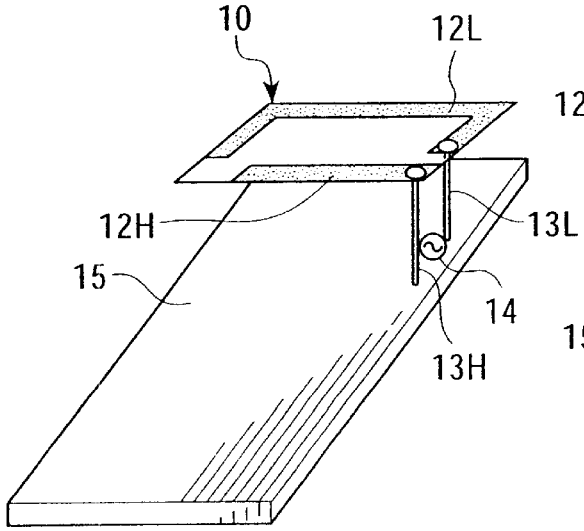
FIGS. 8D–8F show a perspective view, a plan view, and a side view of an example of its modification.
Figure 8E:
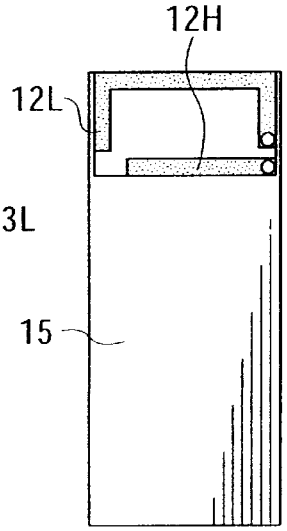
Figure 8F:
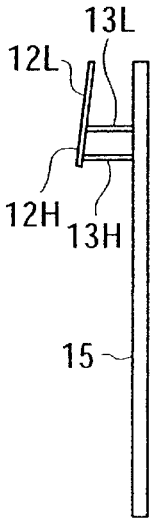
Figure 9A:
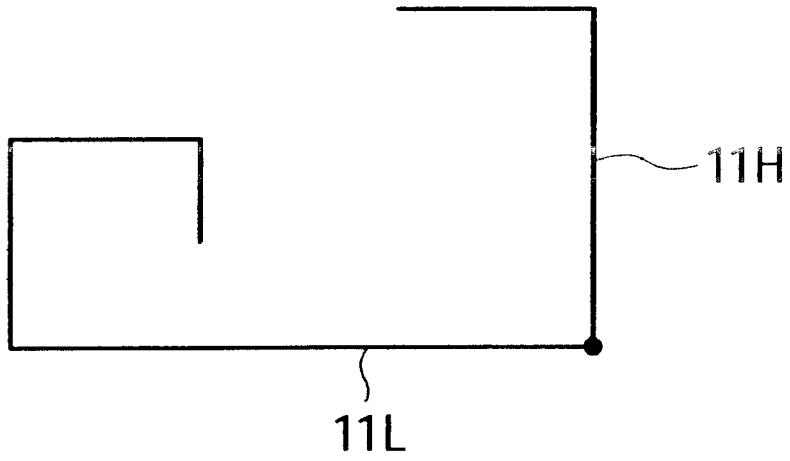
FIGS. 9A–9B are diagrams showing examples of modifications of an embodiment presented in FIG. 8.
Figure 9B:
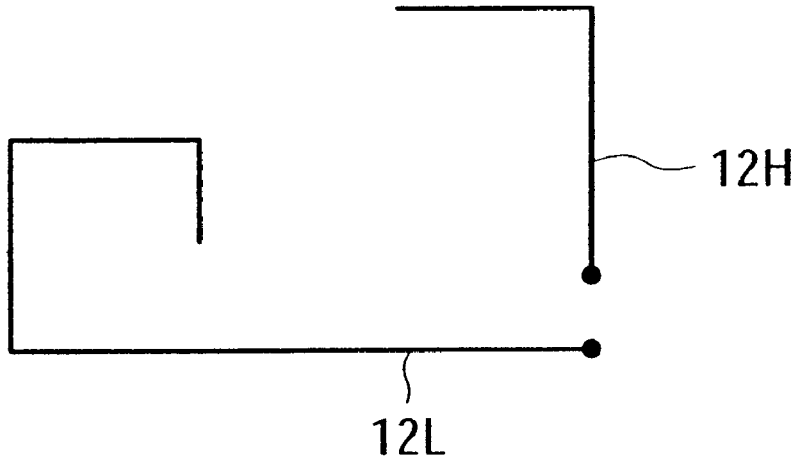
Figure 10A:
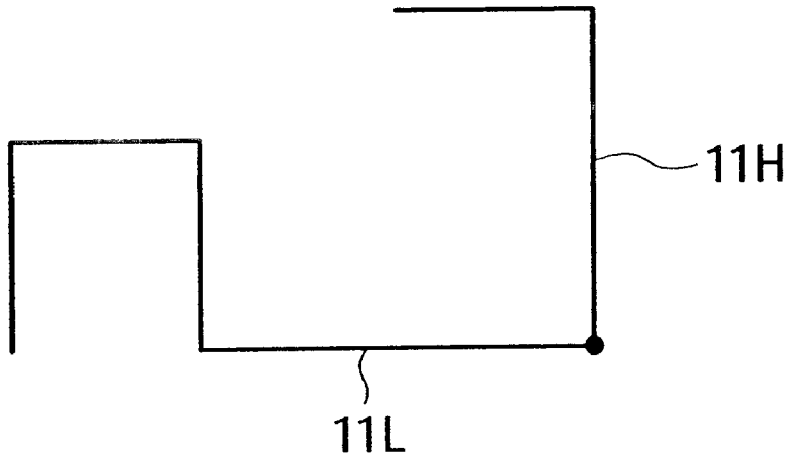
FIGS. 10A–10B show diagrams showing examples of other modifications of an embodiment presented in FIG. 8.
Figure 10B:
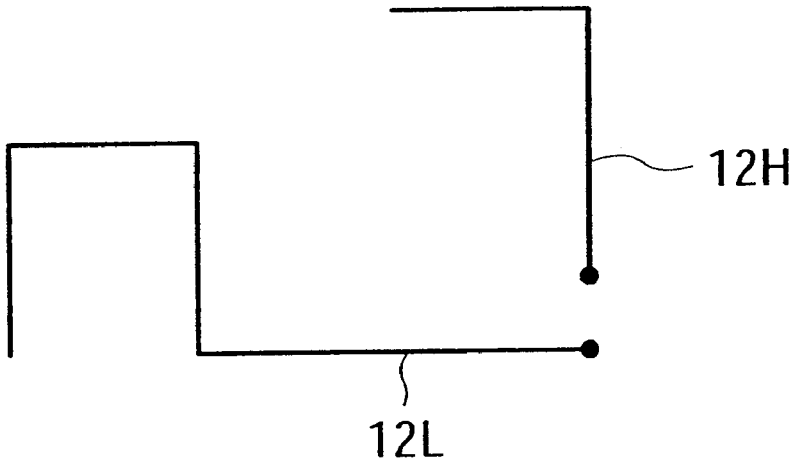
Figure 11A:
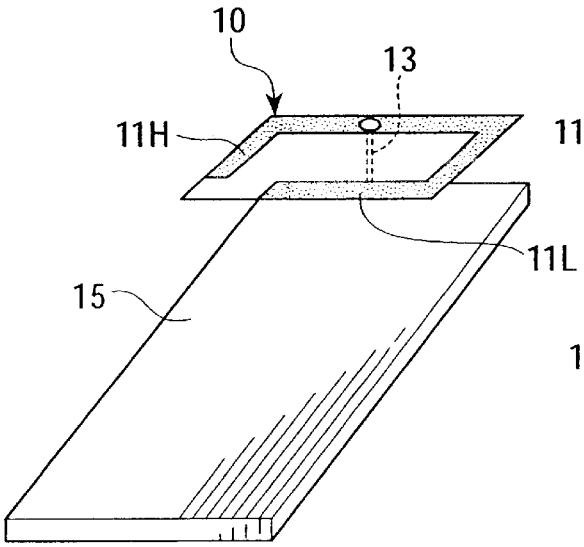
FIGS. 11A–11C show a perspective view, a plan view, and a side view of an example of a dual band built-in antenna device of a fifth preferred embodiment according to the present invention.
Figure 11B:
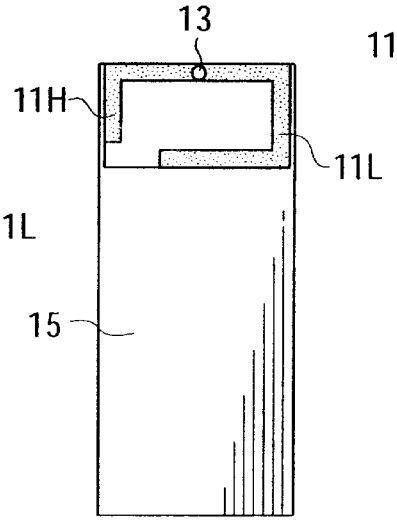
Figure 11C:
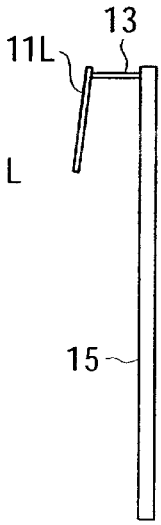
Figure 11D:
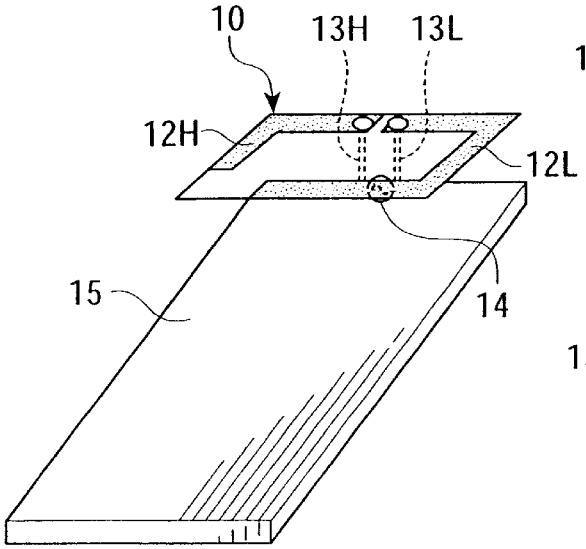
FIGS. 11D–11F show a perspective view, a plan view, and a side view of an example of its modification.
Figure 11E:
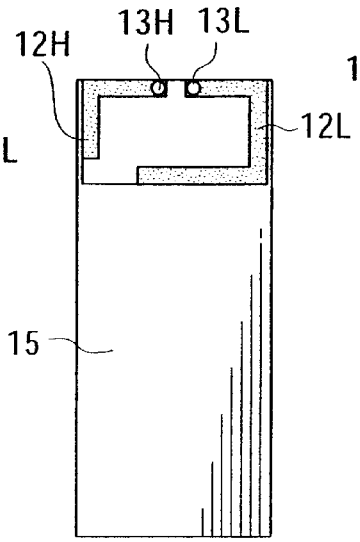
Figure 11F:
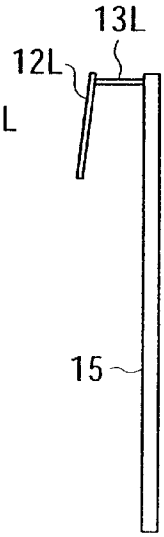

In FIG. 7, a graph is shown as an example of the results of measuring changes in the bandwidth with respect to the ground length when the length of the terminal's ground is varied for the antenna device of the construction shown in FIGS. 6A–6D. The measurement is performed with the assumption of a dual band terminal of the GSM band and the DCS band to determine bandwidths in which VSWR<3 is satisfied. Here, VSWR is an abbreviation of Voltage Standing Wave Ratio, and the antenna size (element length and thickness) is taken as fixed therein. Further, a matching circuit constant is fixed at value in which optimum is achieved at a ground length of 170 mm. In this example, for an antenna size of 20×35×7 ($mm^3$), the matching circuit constant optimum for a ground length Lp=170 mm is set as Lp=2.7(nH). It is assumed that if the matching circuit constant which becomes optimum for each ground length is set, the actual antenna bandwidth will be improved. However, a key feature of the bandwidth variation can be obtained even when the fixed matching circuit constant is used for different ground lengths as the measurements described above.

From the graph of FIG. 7, the following observation can be made: An antenna band substantially corresponding to the frequency band in use for both the GSM band and the DCS band may be realized when the ground length is set on the order of 130 to 140 mm. If the ground length is set on the order of 110 mm, there is an increasing possibility that the antenna band may not be in correspondence with the DCS band even though the antenna band may be in correspondence with the GSM band. If the ground length is set even shorter length of 85 mm or thereabout, conversely, there is an possibility that the antenna band may not be in correspondence with the GSM band while the antenna band may be in correspondence with the DCS band. Namely, in a dual band mobile wireless terminal, there is revealed a possibility that depending on the ground length, the antenna characteristics of either the higher frequency band or the lower frequency band may not become sufficient. Judging from a recent trend of smaller mobile wireless terminals, it should be noted that there are commercially available many mobile wireless terminals having a ground length on the order of 85 to 110 nm which renders the antenna characteristics of either the high band or the low band insufficient. Accordingly, there is no denying that the prevailing situation is disadvantageous to the dual band built-in antennas.

In an antenna device of a fourth embodiment according to the present invention, there is incorporated a design in arranging two antenna elements so as to contribute to improving even to the smallest degree the antenna characteristic of the frequency band which may possibly become unsatisfactory. The antenna characteristic is also determined by a volume occupied by the antenna, and the antenna thickness becomes a critical factor regarding the antenna bandwidth. More specifically, there is a tendency that the larger the thickness of the open end side of the antenna, the wider the antenna bandwidth.

FIGS. 8A–8F show a fourth embodiment of the present invention. A construction thereof features a configuration designed to assure the thickness of each of the radiation conductors 11H and 12H which is the antenna element for the higher frequency band. Namely, the power feed point 14 is disposed at a position corresponding to an inside corner at the side of the antenna element disposition region. Each of the radiation conductors 11H and 12H for the higher frequency band is extended in the transverse direction with respect to the terminal body to place the entire section at the antenna's thickest position. Each of the radiation conductors 11L and 12L for the lower frequency band extends from a position corresponding to the power feed point as the starting point to the top side in the longitudinal direction of the terminal. The radiation conductors 11L and 12L are then folded to the left at the top right corner to further extend along the top side and folded again downward at the top left corner. The configuration shown in FIGS. 8A–8F is effective in the case where the ground length of the terminal is disadvantageous to the higher frequency band as compared with the lower frequency band.

FIGS. 9A–9B and FIGS. 10A–10B present reverse cases of FIGS. 8A–8F, in which the same positions of the power feed points are used as in FIGS. 8A–8F. FIGS. 9A–9B and FIGS. 10A–10B schematically show examples of constructions with two inverted-L antenna elements positioned so as to secure larger antenna thickness at a side in which the antenna elements for the lower frequency band are disposed as compared with that of the antenna elements for the higher frequency band. In both examples given in FIGS. 9A–9B, each of the radiation conductors 11H and 12H for the higher frequency band extends from the position corresponding to the power feed point to the top side in the length direction of the terminal, and is folded to the left at the top right corner and terminated midway at the top side. Each of the radiation conductors 11L and 12L for the lower frequency band extends to the left side up to the left end corner, then is folded upward, and further folded to the right twice. Each of the radiation conductors 11L and 12L terminated at a position where the antenna is comparatively thick. In examples shown in FIGS. 10A–10B, each of the lower frequency band radiation conductors 11L and 12L extends from a starting position corresponding to the power feed point to the left side, is folded upward midway, folded twice to the left, and terminated at the left bottom corner of the antenna element disposition region 10. The examples shown in FIGS. 9A–9B and FIGS. 10A–10B are designed to secure the larger thickness at the open end portions of the lower frequency band antenna elements. Accordingly, the examples are effective when the ground length of the terminal is disadvantageously set to the lower frequency band as compared with the higher frequency band.

FIGS. 11A–11F show an example of a construction in a fifth embodiment of the present invention. In the example, two inverted-L antenna elements are configured so as to secure larger thickness of the antenna for the lower frequency band when the power feed point position is located at the middle part in the transverse direction as the same way as shown in FIGS. 4A–4F. This configuration, too, is effective when the ground length of the terminal is disadvantageously set to the lower frequency band as compared with that of the higher frequency band.

Figure 12A:
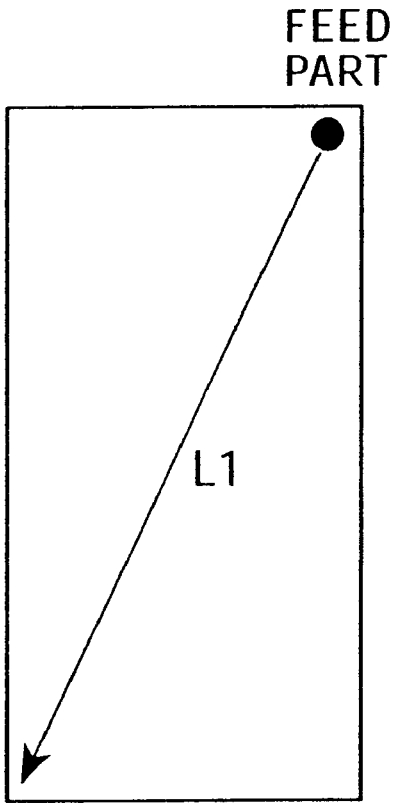
FIGS. 12A–12B show diagrams showing a difference in the way the ground length appears depending on the position of the power feed point of an antenna.
Figure 12B:
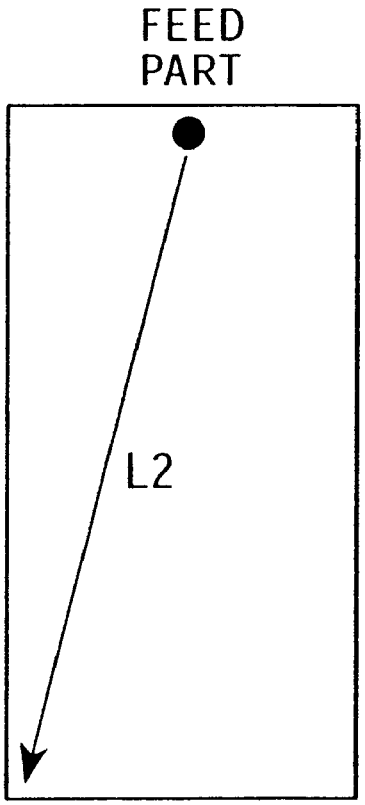
Figure 13A:
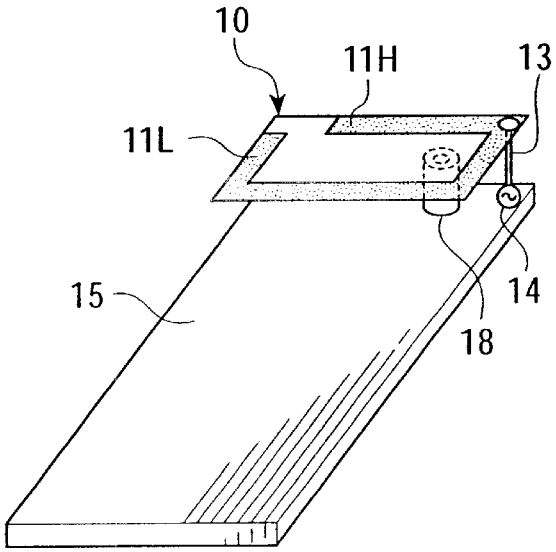
FIGS. 13A–13C show a perspective view, a plan view, and a side view of an example of a dual band built-in antenna device of a sixth preferred embodiment according to the present invention.
Figure 13B:
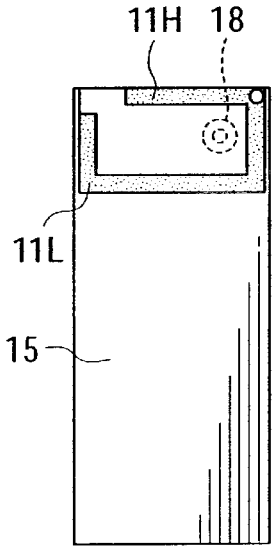
Figure 13C:
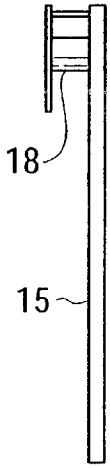
Figure 13D:
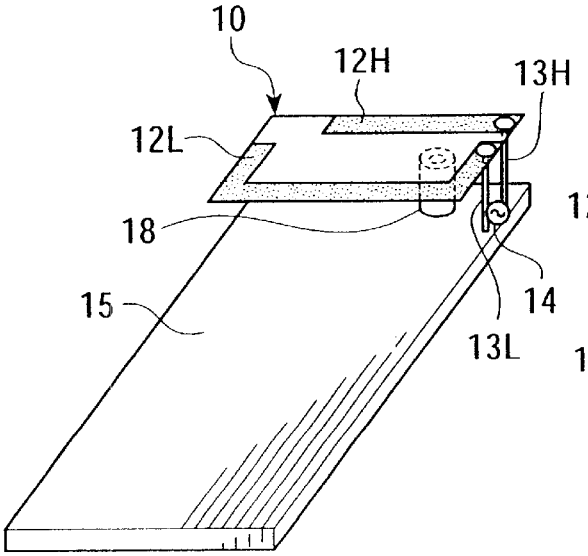
FIGS. 13D–13F show a perspective view, a plan view, and a side view of an example of its modification.
Figure 13E:
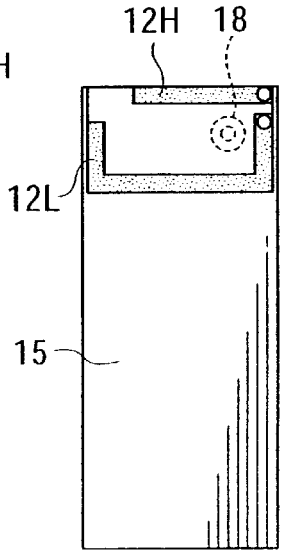
Figure 13F:
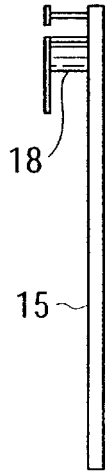
Figure 14A:
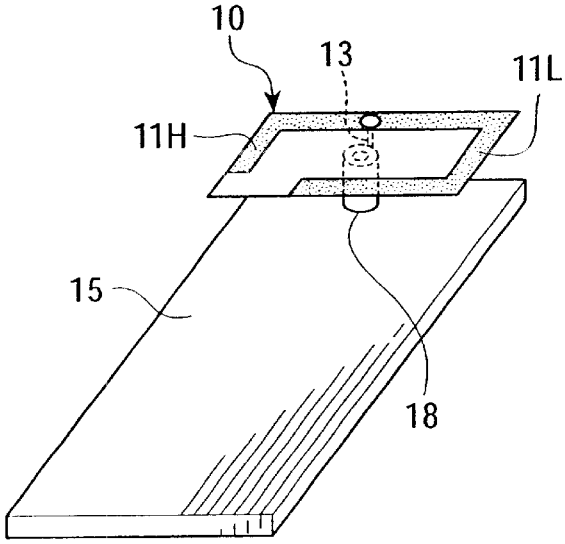
FIGS. 14A–14F show diagrams illustrating examples of modifications of an embodiment presented in FIG. 13.
Figure 14B:
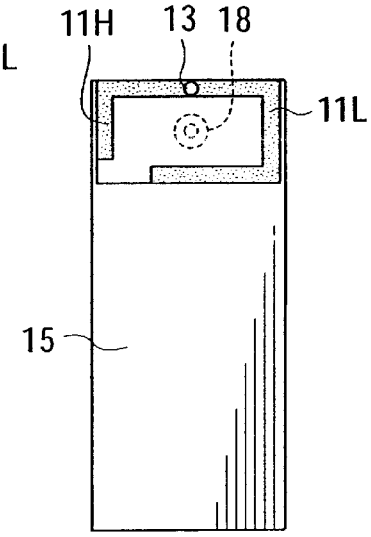
Figure 14C:
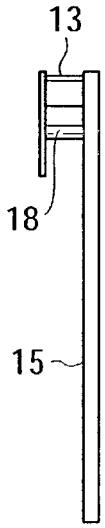
Figure 14D:
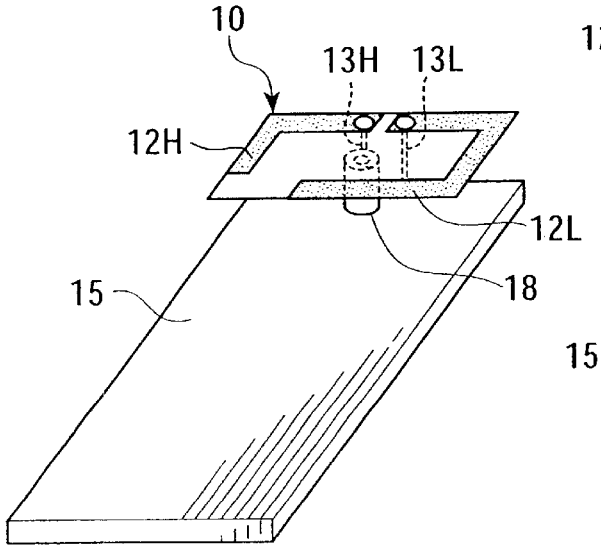
Figure 14E:
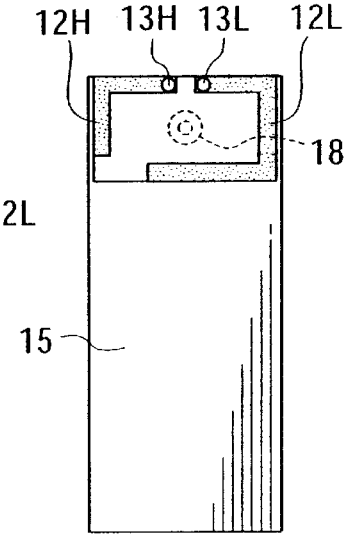
Figure 14F:
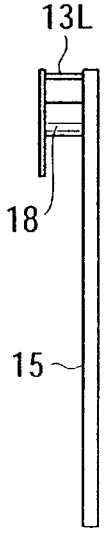
Figure 15A:
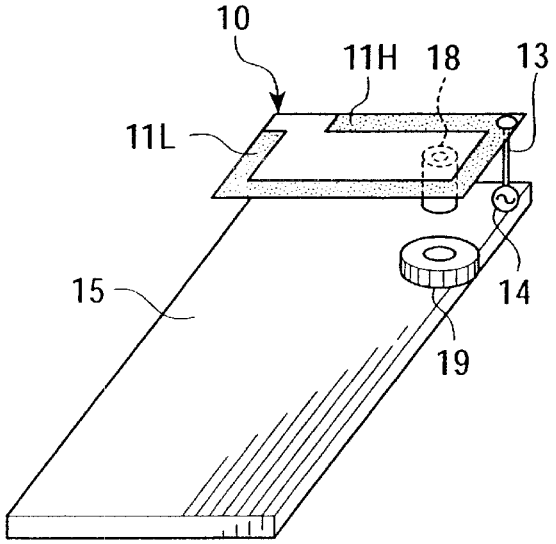
FIGS. 15A–15C show a perspective view, a plan view, and a side view of an example of a dual band built-in antenna device of a seventh preferred embodiment according to the present invention.
Figure 15B:
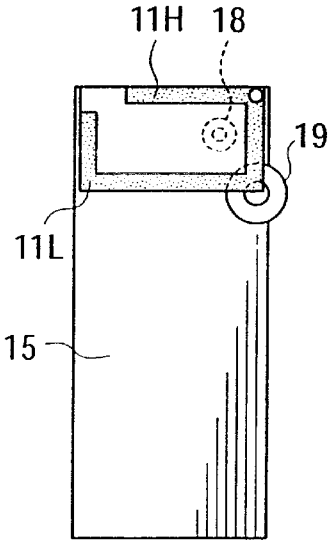
Figure 15C:
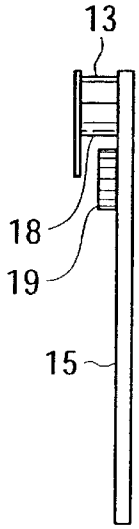
Figure 15D:
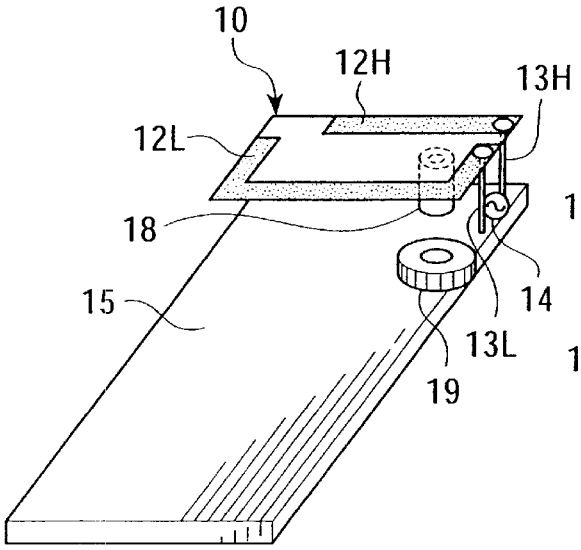
FIGS. 15D–15F show a perspective view, a plan view, and a side view of an example of its modification.
Figure 15E:
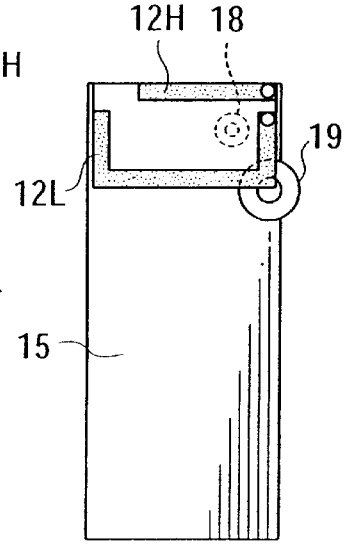
Figure 15F:
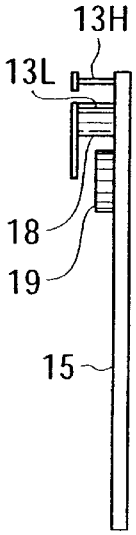
Figure 16A:
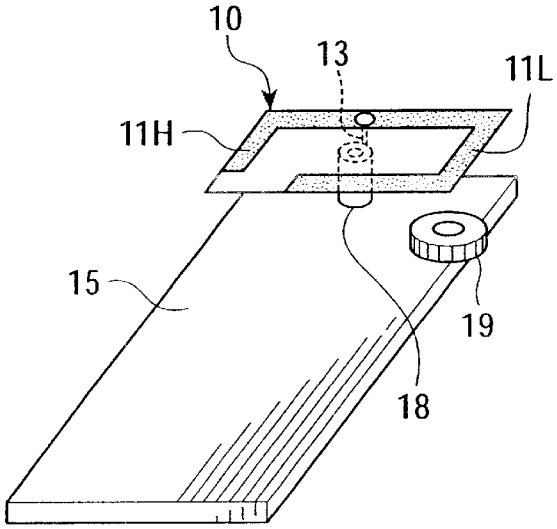
FIGS. 16A–16F show diagrams showing examples of modifications of an embodiment shown in FIG. 15.
Figure 16B:
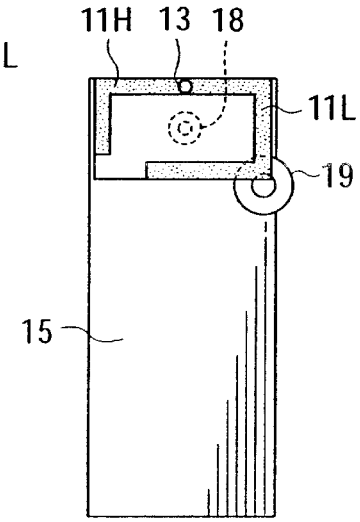
Figure 16C:
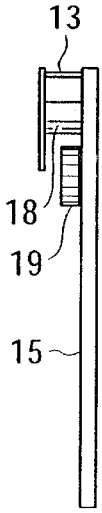
Figure 16D:
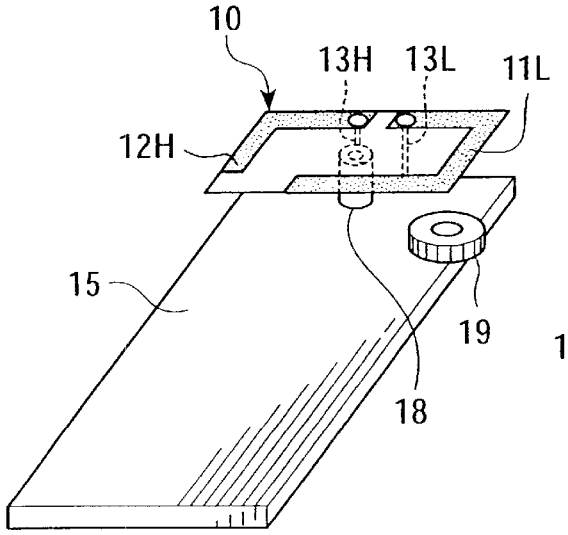
Figure 16E:
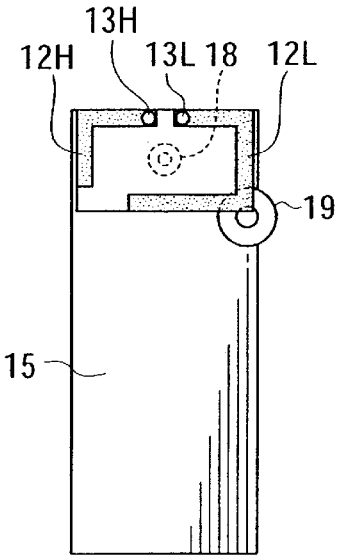
Figure 16F:
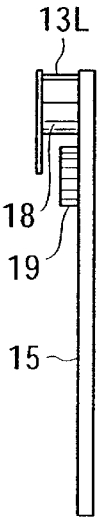

In the examples shown in FIGS. 8–11 mentioned above, the antenna thickness is subjected to tapering to improve the antenna bandwidth by providing larger thickness in the open end portion of the antenna. Furthermore, the improvement of the antenna bandwidth may also be achieved through adjustment of a position of the antenna feed part, that is, the power feed point position of the antenna. For example, when effective ground lengths are compared for the cases that the position of the antenna power feed point (feed part) is positioned on the end of the terminal in the transverse direction (FIG. 12A) and that the feed part position in the middle of the terminal in the transverse direction (FIG. 12B), the effective ground length L2 is measured to be shorter compared with the effective ground length L1. Accordingly, the improvement of the antenna bandwidth of either frequency band may be accomplished as well by adjusting the power feed point position as described above to utilize the effective ground length. For example, the end feed type shown in FIG. 1 and the central feed type shown in FIG. 4 have different antenna bandwidths despite the same ground length and the same antenna occupying volume. Therefore, in the case where the tapering cannot be applied to the antenna thickness, the adjustment of the power feed point position may very well prove to be effective in improving the overall antenna bandwidth.

Next, a sixth embodiment of a dual band built-in antenna device according to the present invention will be described with reference to FIGS. 13A–13F and FIGS. 14A–14F. In an antenna device of the present embodiment, there lies a portion of comparatively wide area in the antenna element disposition region 10 that is devoid of any radiation conductors in between the two inverted-L antenna elements for purposes of avoiding the mutual coupling effect. Specifically, the portion devoid of any radiation conductor exists between the radiation conductor 11H and the radiation conductor 11L or between the radiation conductor 12H and the radiation conductor 12L. FIGS. 13A–13F show examples in which an external antenna connector 18 is disposed in the portion devoid of any radiation conductor. In this specification, the external antenna is assumed to be different from the above-mentioned whip antenna. More specifically, when an external antenna is connected and operated as an antenna of a mobile wireless terminal and if reduced losses is to be taken into consideration, it is desirable for such external antenna connector to be in proximity to the antenna power feed point disposed inside. Accordingly, the construction in the present examples has an advantage in light of above-cited standpoint. According to the present embodiment, the portion devoid of any radiation conductor in the antenna element disposition region covers a comparatively wide area, thereby contributing to providing a high degree of freedom in selecting a position at which the external antenna connector 18 is to be disposed. However, it is also desirable to keep the external antenna connector 18 from not being in too close proximity to the open end portion of both antenna elements for purposes of avoiding any possible effect on the antenna characteristic.

As shown in FIGS. 14A–14F, in the case where the power feed point position is set in the middle part, in the same way as FIGS. 13A–13F, the external antenna connector 18 may be disposed in the part devoid of any radiation conductor, and the same applies to other disposing positions of the power feed point.

Referring to FIGS. 15A–15F and FIGS. 16A–16F, a seventh embodiment of an antenna device according to the present invention will be described. As mentioned above, in the dual band mobile wireless terminal, there is a possibility that either one of the antenna bandwidths of the frequency bands may not be as good as the other bandwidth depending on the ground length and/or the power feed position of the antenna. On the other hand, there is possibility that some degree of degradation in the antenna characteristic may be tolerable for the frequency band having the better antenna bandwidth. It is, therefore, a feature and advantage of an antenna device of the present embodiment that a component part not overly made up of metals may be disposed in proximity to an inverted-L antenna element of the frequency band having the better antenna bandwidth. The examples of the present embodiment enumerated in FIGS. 15A–15F and FIGS. 16A–16F are assumed that the antenna bandwidth for the lower frequency band is set satisfactory. FIGS. 15A–15F show a case where the power feed point is positioned at one end part. FIGS. 16A–16F show a case where the power feed point is positioned at middle part. In either case, there is shown the examples of juxtaposing the external antenna connector 18. However, the external antenna connector 18 itself is not essential features in the present embodiment.

In the examples shown FIGS. 15A–15F and FIGS. 16A–16F, there is shown an embodiment wherein a dial operating mechanism 19 is disposed between the inverted-L antenna element and the ground plane for performing electrical operations for the terminal such as telephone number retrieval. While the dial operating mechanism 19 naturally has an electrical connection with an internal circuit, the dial itself is normally formed of non-conductive material such as resin. Accordingly, its presence in that position does not constitute the presence of a large metallic material in proximity to the antenna element. No appreciable effect is exerted upon the antenna characteristics. Further, the operation of the dial operating mechanism 19 requires a finger to approach the antenna elements, thereby giving rise to a concern of possible degradation of the antenna characteristics. However, an amount of degradation, if any, will remain to be less than considerable as long as the antenna bandwidth is set to satisfactory value.

There is introduced only the examples of the dial operating mechanism 19 disposed between the inverted-L antenna element on the lower frequency band and the ground. Alternatively, it is possible to dispose the dial operating mechanism 19 between the inverted-L antenna element on the higher frequency band and the ground as long as the antenna bandwidth on the higher frequency band is set satisfactory, In addition, a part to be installed in these examples is not restricted to the dial operating mechanism described above, but other parts than the dial operating mechanism may also be arranged to be installed there.

Figure 17:
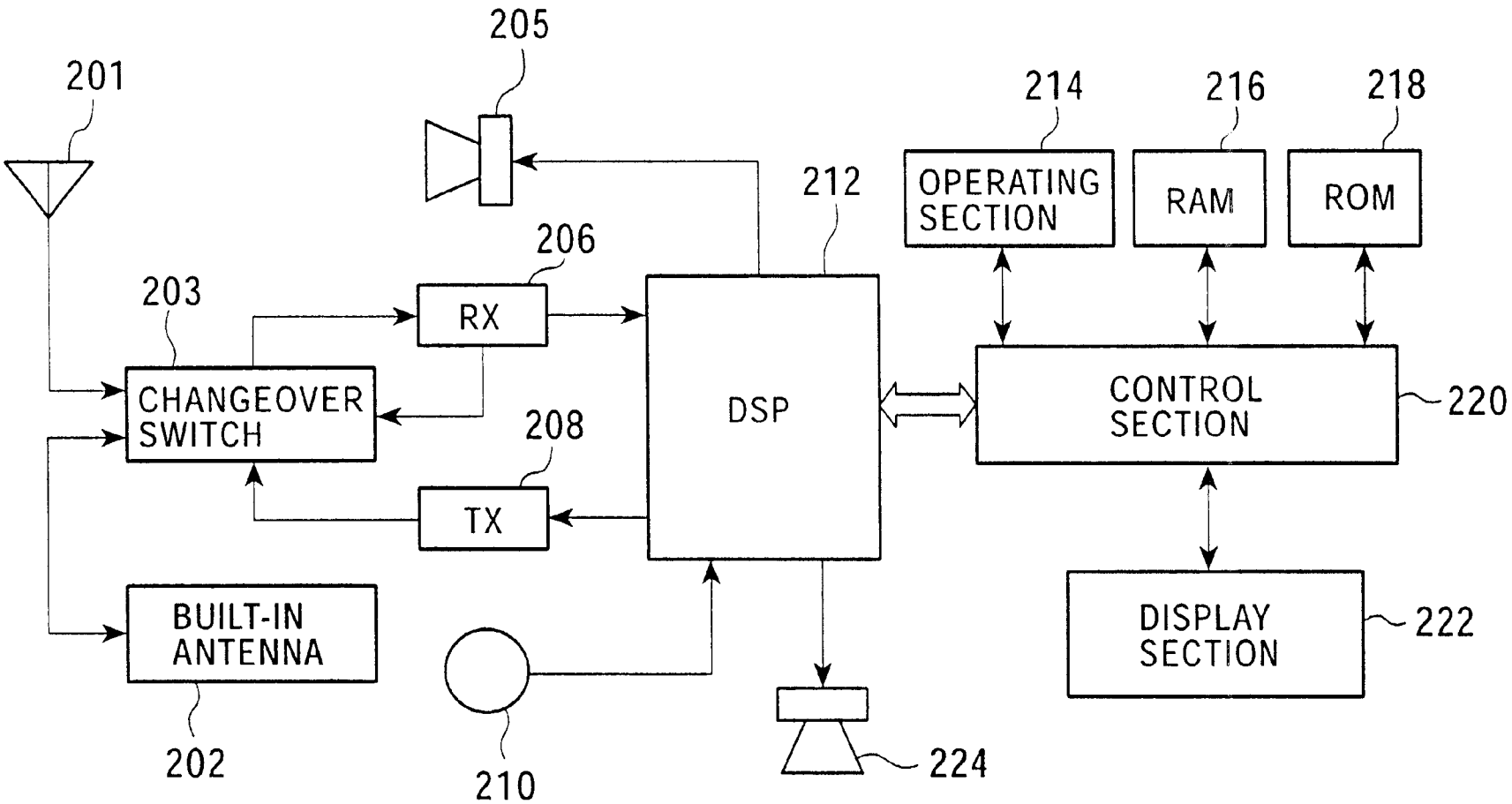
FIG. 17 shows a block diagram showing the construction of a mobile telephone as a mobile wireless terminal apparatus employing a built-in antenna device according to the present invention.
Figure 18:
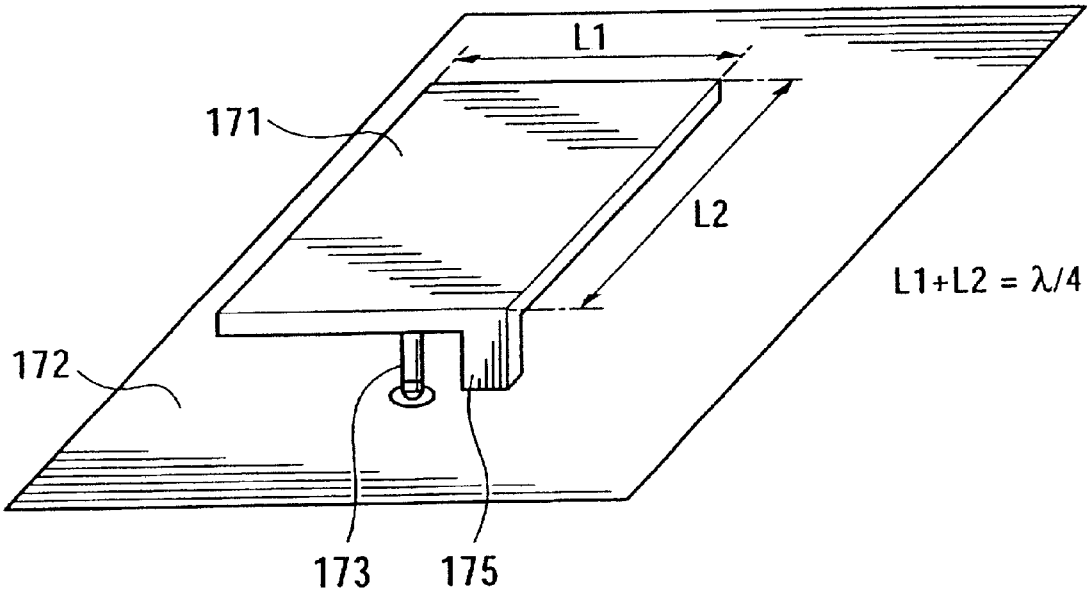
FIG. 18 (RELATED ART)
FIG. 18 shows a diagram showing a structural example of a micro-strip inverted F antenna as a built-in antenna for a mobile wireless terminal apparatus in related art.
Figure 19:
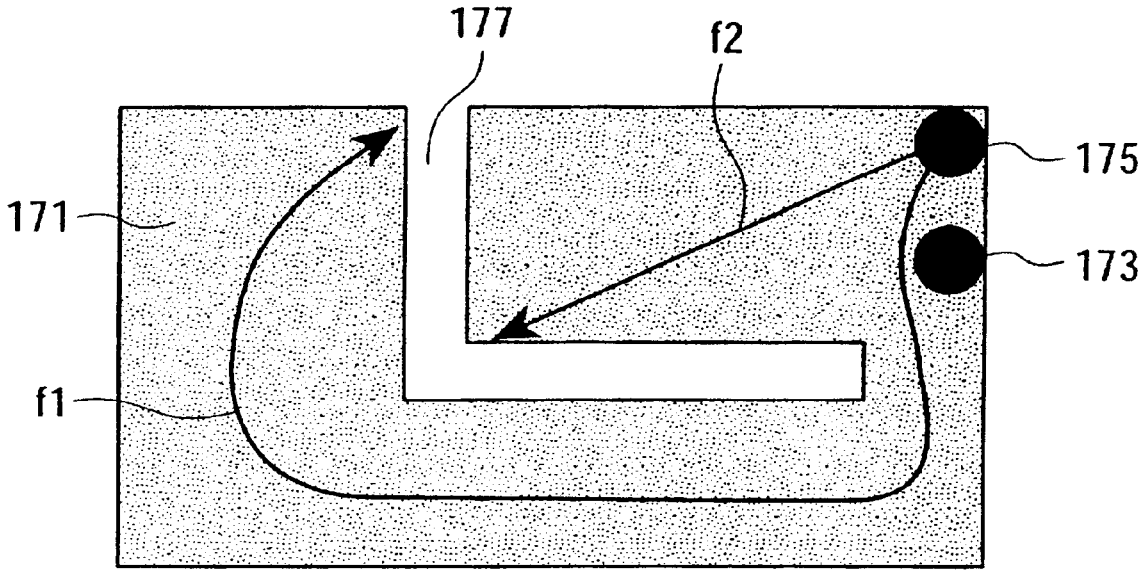
FIG. 19 (RELATED ART)
FIG. 19 shows a diagram showing a structural example of a micro-strip inverted F antenna that has a dual band operability.
Figure 20A:
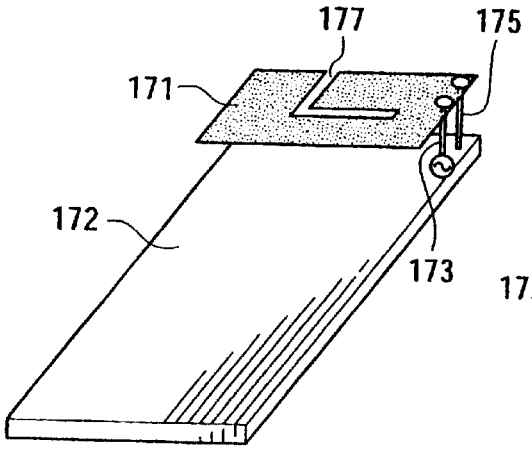
FIG. 20A (RELATED ART)
FIG. 20A–20C show a perspective view, a plan view, and a side view of a structural example of a dual band micro-strip inverted F antenna installed on a mobile wireless terminal apparatus for mobile communications.
Figure 20B:
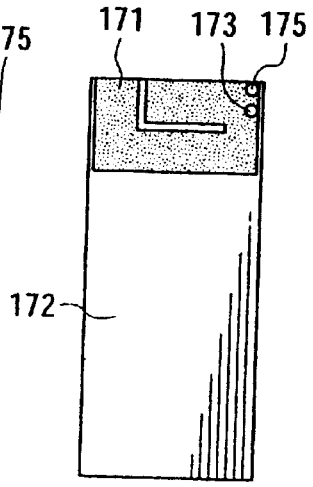
FIG. 20B (RELATED ART)
Figure 20C:
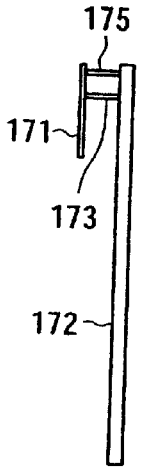
FIG. 20C (RELATED ART)

Finally, as one example of a mobile wireless terminal apparatus according to one embodiment of the present invention, a mobile telephone employing one of the built-in antenna devices described above will be outlined with reference to FIG. 17. In addition to a built-in antenna 202, the mobile telephone of the present embodiment is provided with a whip antenna 201 as an external antenna exposed to outside the frame. The whip antenna 201 and the built-in antenna 202 are used for carrying out diversity reception, although the whip antenna 201 and diversity reception are not essential features in the present embodiment.

In a receiving system of the mobile telephone, receiving signals received through the antennas 201 and 202 are sent to a receiving circuit (RX) 206 via a change-over switch 203 serving as a shared device for the antennas. The change-over switch 203 not only switches transmission and reception but also jointly operate with a receiving circuit 206 to select a higher level of the receiving signals from the antenna 201 and 202. The receiving circuit 206 demodulates the received signal and converts the signals via an A/D conversion to digital signals. The digital signal is then subjected to predetermined processing performed by the DSP (Digital Signal Processor) 212 that is functioning as the CODEC under the control of a control section 220, and outputted to a receiver speaker 224 and/or an output speaker 205 for outputting voice, alarm or the like.

In a transmission system, voice signal collected by a microphone 210 is converted by the DSP 212 to digital voice data based on control of the control section 220. The voice data is then subjected to predetermined modulation processing in a transmission circuit (TX) 208 and further subjected to digital-analog conversion processing as well as frequency conversion processing. Thereafter, the voice data is sent through the change-over switch 203 and transmitted via the antenna 201 or 202.

The control section 220 comprise, for example, a central processing unit (CPU) or the like, and is connected to a random access memory (RAM) 214, a read only memory (ROM) 218 or the like. The control section 220 controls an operating section 214 including input means such as an input key and a jog dial, and a display section 222 such as LCD in addition to the above-mentioned DSP 212.

While the present invention has been particularly shown and described with reference to embodiments according to the present invention, it will be understood by those skilled in the art that other changes in form and details can be made therein without departing from the essential character thereof.

For example, while the power feed conductor is shown as a pin, its shape does not necessarily need to be limited thereto. Alternatively, the power feed conductor may be a conductive piece integrally formed of at least one of the first and the second antenna elements. Further, joint use of the GSM band and the DCS band has been described as the specific example. However, other combinations are possible as well. Moreover, while the examples of the terminal that can be operated in two frequency bands have been shown, the present invention can also be expanded so that it can be operated in three frequency bands by adding a third antenna element.

What is claimed is:

1. A dual band built-in antenna device operable in a first frequency band and a second frequency band comprising:

a ground plane comprising a ground member;

a first inverted-L line antenna element for said first frequency band; and a second inverted-L line antenna element for said second frequency band; wherein said first and second inverted-L line antenna elements are so constructed that the elements are extended to respective directions that are further separated from each other as the antenna elements extend further from a starting position set in proximity to a power feed point within a plane parallel to said ground plane.

2. The dual band built-in antenna device according to claim 1, wherein said power feed point is disposed at a position corresponding to a corner of a substantially rectangular antenna element disposition region in which said first and second inverted-L line antenna elements are disposed thereon.

3. The dual band built-in antenna device according to claim 1, wherein said power feed point is disposed at a position corresponding to a middle part in a transverse direction of a substantially rectangular antenna element disposition region in which said first and second inverted-L line antenna elements are disposed thereon.

4. The dual band built-in antenna device according to claim 1, further comprising:

a plane facing to said ground plane in which said first and second inverted-L line antenna elements are disposed thereon, wherein said plane is slanted toward said ground plane, and at least one of open ends of said first and second inverted-L line antenna elements is being terminated at a position on said plane, said point being comparatively longer distance from said ground plane.

5. The dual band built-in antenna device according to claim 4, wherein one of the open ends of said first and second inverted-L line antenna elements is terminated on said plane at a position locating at a comparatively longer distance from said ground plane, and the other open end of said first and second inverted-L line antenna elements is terminated on said plane at a position locating at a comparatively shorter distance from said ground plane.

6. The dual band built-in antenna device according to claim 1, wherein an external antenna connector is disposed at a part devoid of radiation conductor, the part being located in between said first and second inverted-L line antenna elements.

7. The dual band built-in antenna device according to claim 1, wherein a nonconductive component part is disposed between either antenna element of said first or second inverted-L line antenna element and said ground member.

8. The dual band built-in antenna device according to claim 1, further comprising:

a power feed conductor being coupled to said power feed point, wherein portions of said first and second inverted-L line antenna elements disposed on a plane substantially parallel to said ground plane are connected to said power feed point.

9. The dual band built-in antenna device according to claim 1, further comprising:

a first and a second power feed conductors being coupled to a first and a second power feed point respectively, wherein said first and second inverted-L line antenna elements disposed on a plane substantially parallel to said ground plane have respective end portions that are connected to said first and second power feed points, respectively.

10. The dual band built-in antenna device according to claim 1, further comprising:

a matching circuit being shared with said first and second inverted-L line antenna elements.

11. A mobile wireless terminal apparatus having a dual band built-in antenna device operable in a first frequency band and a second frequency band, said mobile wireless terminal apparatus comprising:

a ground plane comprising a ground member;

a first inverted-L line antenna element for said first frequency band; and a second inverted-L line antenna element for said second frequency band; wherein said first and second inverted-L line antenna elements are so constructed that the elements are extended to respective directions that are further separated from each other as the antenna elements extend further from a starting position set in proximity to a power feed point within a plane parallel to said ground plane.

12. The mobile wireless terminal apparatus according to claim 11, wherein said power feed point is disposed at a position corresponding to a corner of a substantially rectangular antenna element disposition region in which said first and second inverted-L line antenna elements are disposed thereon.

13. The mobile wireless terminal apparatus according to claim 11, wherein said power feed point is disposed at a position corresponding to a middle part in a transverse direction of a substantially rectangular antenna element disposition region in which said first and second inverted-L line antenna elements are disposed thereon.

14. The mobile wireless terminal apparatus according to claim 11, further comprising:

a plane facing to said ground plane in which said first and second inverted-L line antenna elements are disposed thereon, wherein said plane is slanted toward said ground plane, and at least one of open ends of said first and second inverted-L line antenna elements is being terminated at a position on said plane, said point being comparatively longer distance from said ground plane.

15. The mobile wireless terminal apparatus according to claim 14, wherein one of the open ends of said first and second inverted-L line antenna elements is terminated on said plane at a position locating at a comparatively longer distance from said ground plane, and the other open end of said first and second inverted-L line antenna elements is terminated on said plane at a position locating at a comparatively shorter distance from said ground plane.

16. The mobile wireless terminal apparatus according to claim 11, wherein an external antenna connector is disposed at a part devoid of radiation conductor, the part being located in between said first and second inverted-L line antenna elements.

17. The mobile wireless terminal apparatus according to claim 11, wherein a nonconductive component part is disposed between either antenna element of said first or second inverted-L line antenna element and said ground member.

18. The mobile wireless terminal apparatus according to claim 11, further comprising:

a power feed conductor being coupled to said power feed point, wherein portions of said first and second inverted-L line antenna elements disposed on a plane substantially parallel to said ground plane are connected to said power feed point.

19. The mobile wireless terminal apparatus according to claim 11, further comprising:

a first and a second power feed conductors being coupled to a first and a second power feed point respectively, wherein said first and second inverted-L line antenna elements disposed on a plane substantially parallel to said ground plane have respective end portions that are connected to said first and second power feed points, respectively.

20. The mobile wireless terminal apparatus according to claim 11, further comprising:

a matching circuit being shared with said first and second inverted-L line antenna elements.

* * * * *